US011118413B2

(12) United States Patent
Roper et al.

(10) Patent No.: US 11,118,413 B2
(45) Date of Patent: Sep. 14, 2021

(54) VERTICAL LIFT ROTARY TABLE

(71) Applicant: Ensco International Incorporated, Wilmington, DE (US)

(72) Inventors: Richard Robert Roper, Katy, TX (US); John Stokes Knowlton, Houston, TX (US); Christopher Scott Stewart, Cornelius, NC (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 16/716,491

(22) Filed: Dec. 16, 2019

(65) Prior Publication Data

US 2020/0190918 A1 Jun. 18, 2020

Related U.S. Application Data

(60) Provisional application No. 62/780,301, filed on Dec. 16, 2018.

(51) Int. Cl.

| | |
|---|---|
| ***E21B 3/04*** | (2006.01) |
| ***E21B 19/14*** | (2006.01) |
| ***E21B 19/16*** | (2006.01) |
| ***E21B 19/10*** | (2006.01) |
| ***E21B 19/24*** | (2006.01) |

(52) U.S. Cl.

CPC ..... *E21B 19/14* (2013.01); *E21B 3/045* (2013.01); *E21B 19/10* (2013.01); *E21B 19/161* (2013.01); *E21B 19/24* (2013.01)

(58) Field of Classification Search

CPC ..... E21B 3/045; E21B 19/14; E21B 19/10; E21B 19/161; E21B 19/24

See application file for complete search history.

(56) References Cited

U.S. PATENT DOCUMENTS

| | | | | |
|---|---|---|---|---|
| 2009/0126941 | A1 | 5/2009 | Laitolais, Jr. et al. | |
| 2011/0103922 | A1* | 5/2011 | Belik | E21B 19/155 414/22.58 |
| 2012/0195716 | A1* | 8/2012 | Nouwens | F16L 1/207 414/22.55 |
| 2018/0274307 | A1 | 9/2018 | Stewart et al. | |

FOREIGN PATENT DOCUMENTS

| | | |
|---|---|---|
| WO | 2011016719 | 2/2011 |
| WO | 2011056711 | 5/2011 |
| WO | 2017087200 | 5/2017 |

OTHER PUBLICATIONS

PCT Application No. PCT/US2019/066671 International Search Report and Written Opinion, dated Apr. 21, 2020, 12 pgs.

* cited by examiner

*Primary Examiner* — Taras P Bemko
(74) *Attorney, Agent, or Firm* — Fletcher Yoder, P.C

(57) ABSTRACT

A system, includes a movable platform slidingly coupled to one or more supports and configured to be selectively moved towards a drill floor and away from the drill floor. The system also includes a roughneck disposed on the movable platform and configured to make up or break out a threaded joint between a first tubular segment and a second tubular segment. The system additionally includes a support member disposed on the movable platform and configured to support one of the first tubular segment or the second tubular segment as the movable platform is selectively moved towards a drill floor or away from the drill floor.

20 Claims, 21 Drawing Sheets

VERTICAL LIFT ROTARY TABLE

CROSS REFERENCE TO RELATED APPLICATIONS

This application is a Non-Provisional Application claiming priority to U.S. Provisional Patent Application No. 62/780,301, entitled "Vertical Lift Rotary Table", filed Dec. 16, 2018, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. Likewise, drilling advances have allowed for increased access to land based reservoirs.

Much of the time spent in drilling to reach these reservoirs is wasted "non-productive time" (NPT) that is spent in doing activities which do not increase well depth, yet may account for a significant portion of costs. For example, when drill pipe is pulled out of or lowered into a previously drilled section of well it is generally referred to as "tripping." Accordingly, tripping-in may include lowering drill pipe into a well (e.g., running in the hole or RIH) while tripping-out may include pulling a drill pipe out of the well (pulling out of the hole or POOH). Tripping operations may be performed to, for example, installing new casing, changing a drill bit as it wears out, cleaning and/or treating the drill pipe and/or the wellbore to allow more efficient drilling, running in various tools that perform specific jobs required at certain times in the oil well construction plan, etc. Additionally, tripping operations may require a large number of threaded pipe joints to be disconnected (broken-out) or connected (made-up). This process may involve halting of the pipe joints at a fixed position to allow for the tripping operation to be undertaken, which can greatly extend the time required to complete a tripping operation.

DETAILED DESCRIPTION

Figure 1:
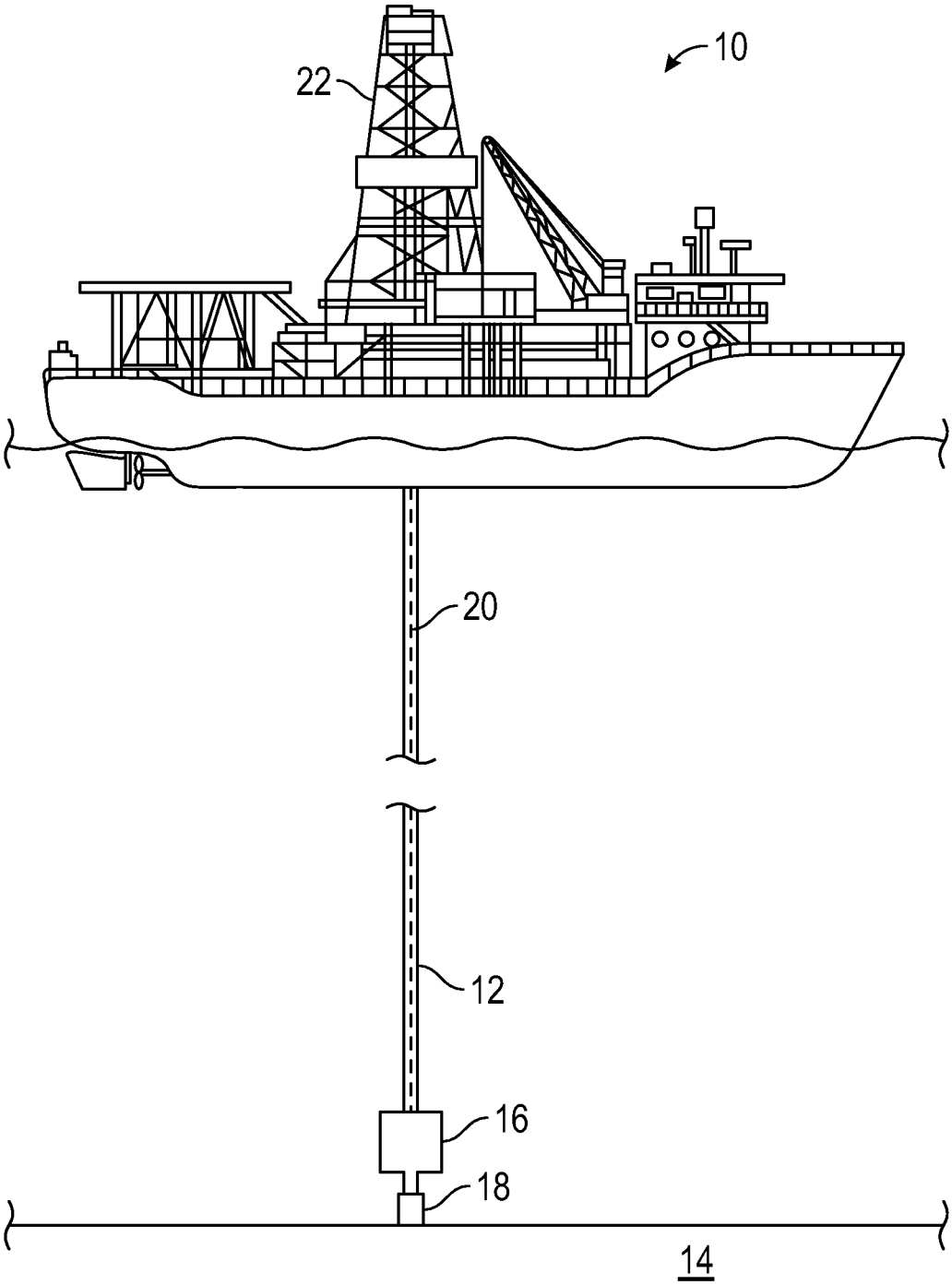
FIG. 1 illustrates an example of an offshore platform having a riser coupled to a blowout preventer (BOP), in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Oil and gas drilling operations on land and offshore require frequent movement of the drill string in and out of the well bore to facilitate the drilling process. This process becomes very time consuming when drilling deep wells. The drilling string is comprised of drill pipe segments that are connected together with a coupling. The coupling may be, for example a threaded connection with a pin and box end. The drill pipe segments are connected together mechanically by a roughneck machine (e.g., an iron roughneck or more simply a roughneck). Thus, present embodiments are directed to components, systems, and techniques utilized in an automated tripping apparatus.

The automated tripping apparatus may include a movable platform (e.g., a movable support) slidingly coupled to a frame and positioned to be selectively moved towards and away from a tubular segment support system. In some embodiments, the movable platform may include a rotary table on a drilling rig that provides rotational force (e.g., in a clockwise direction) to a drill string to facilitate the process of drilling a borehole. The rotary table may be used in conjunction with or as a back-up to a top drive. The movable platform may also be of a sufficient size to support a roughneck. The roughneck may be disposed upon the movable platform, for example, between the movable platform and the tubular segment support system. The roughneck may be positioned to make up or break out a threaded joint between a first and a second tubular segment of a tubular string as part of a tripping operation. This process may be repeatable and may be undertaken as the movable platform is in transition toward or away from the tubular segment support system.

As the drill string is made longer by connected drill pipe, it can be supported by, for example, drilling slips, elevators, or similar systems as the tubular segment support system. The drilling slips may also be contained in the movable platform (e.g., as part of the rotary table therein). A rotary table is typically mounted to the drill floor substructure for support of the drill string loads; however, as previously noted, in present embodiments, the rotary table itself is movable in conjunction with the movable platform and, thus, is not mounted to the drill floor during a tripping operation.

In some embodiments, the automated tripping apparatus may operate to make up and break out tubular segments of a tubular string being tripped in or out of a wellbore (or towards or away from a wellbore) while the tubular string is in continuous motion (e.g., which, in some embodiments, may be at a constant speed). Because the tubular string is in constant motion, the tubular string may be able to be tripped in the same amount as time as a traditional discontinuous tripping procedure while the tubular string remains at a slower speed than would be reached by a tubular string in a discontinuous tripping operation. This may reduce "surging" while tripping-in, or "swabbing" while tripping-out, e.g., pressure fluctuations that may cause, for example, reservoir fluids to flow into the wellbore or cause instability in a formation surrounding a wellbore as well as, for example, hydraulic shocks that may result from starting and stopping of a tubular string in the wellbore. In other embodiments, tripping may be performed at, for example, the same speed as performed in conjunction with a discontinuous tripping operation but because the tubular string is in constant motion, and does not include stopping times to make up or break out segments of the tubular string, the time to complete a tripping operation may be reduced relative to a discontinuous tripping operation with no increaseto the speed at which the tripping operation is undertaken.

Accordingly, present embodiments consist of a movable platform (e.g., vertically or at an incline, in the situation of directional or slant drilling) in which the rotary table may be mounted. This movable platform may interface with the existing rig structure such as the top drive dolly tracks, rig derrick, or similar. The movable platform may allow the attachment of various other machines or appendages such as a stabbing arm, roughneck, lift cylinders, cables, sensors, or similar components.

The movable platform may be recessed into the drill floor structure to allow it to be used in a conventional drilling application, or alternatively, be placed on top of the drill floor. In some embodiments, the movable platform may have guide pins or similar to provide coarse and fine alignment when moving in and out of the drill floor. The movable platform may be raised and lowered with a cable and sheave arrangement, direct acting cylinders, suspended winch mechanism, or similar internal or external actuation system. In some embodiments, the movable platform may use a lateral supports such as, for example, pads that may be made of Teflon-graphite material or another low-friction material (e.g., a composite material) that allows for motion of the movable platform relative to drill floor with reduced friction characteristics. In addition to, or in place of the aforementioned pads, other lateral supports including bearing or roller type supports (e.g., steel or other metallic or composite rollers and/or bearings) may be utilized. The lateral supports may allow the movable platform to interface with a support element (e.g., guide tracks, such as top drive dolly tracks) so that the movable platform is movably coupled to the support element. Accordingly, the movable platform may be movably coupled a support element to allow for movement of the movable platform (e.g., towards and away from the drill floor and/or the tubular segment support system while maintaining contact with the guide tracks or other connection element.

In some embodiments, the movable platform may additionally include a tubular segment support member that operates to hold (i.e., support) the tubular segment in connection with the movement of the movable platform. Additionally, the tubular segment support member may operate to move the supported tubular segment, for example, in a direction from a first position at an edge of an upper face of the movable platform, across the upper face of the movable platform, and to a second position at a central region of the upper face of the movable platform so as to position the tubular segment for connection with a second tubular segment. In this manner, the tubular segment support member may impart lateral movement to the tubular segment that is perpendicular in direction to the movement of the movable platform. In some embodiments, the tubular segment support member may be an arm termed a stabbing arm. The tubular segment support member may be referred to as a tubular segment support system or may be a portion of a tubular segment support system.

Additionally, in some embodiments, a tubular segment support system may include a guide member. The guide member may be positioned in line with the first position of the tubular segment support member and the guide member may move in conjunction with the tubular segment support member (e.g., provide lateral movement perpendicular in direction to the movement of the movable platform). This may allow the guide member to operate as a tubular segment restriction element by restricting additional movement of the tubular segment distinct from the lateral movement imparted by tubular segment support member or movement imparted by the movable platform. Other movements may also occur via the guide member so as to operate as a guide and/or support to a tubular segment as it, for example, is moved via the tubular segment support member.

With the foregoing in mind, FIG. 1 illustrates an offshore platform 10 as a drillship. Although the presently illustrated embodiment of an offshore platform 10 is a drillship (e.g., a ship equipped with a drilling system and engaged in offshore oil and gas exploration and/or well maintenance or completion work including, but not limited to, casing and tubing installation, subsea tree installations, and well capping), other offshore platforms 10 such as a semi-submersible platform, a spar platform, a floating production system, or the like may be substituted for the drillship. Indeed, while the techniques and systems described below are described in conjunction with a drillship, the techniques and systems are intended to cover at least the additional offshore platforms 10 described above. Likewise, while an offshore platform 10 is illustrated and described in FIG. 1, the techniques and systems described herein may also be applied to and utilized in onshore drilling activities. These techniques may also apply to at least vertical drilling or production operations (e.g., having a rig in a primarily vertical orientation drill or produce from a substantially vertical well) and/or directional drilling or production operations (e.g., having a rig in a primarily vertical orientation drill or produce from a substantially non-vertical or slanted well or having the rig oriented at an angle from a vertical alignment to respective to drill or produce from a substantially non-vertical or slanted well).

As illustrated in FIG. 1, the offshore platform 10 includes a riser string 12 extending therefrom. The riser string 12 may include a pipe or a series of pipes that connect the offshore platform 10 to the seafloor 14 via, for example, a BOP 16 that is coupled to a wellhead 18 on the seafloor 14. In some embodiments, the riser string 12 may transport produced hydrocarbons and/or production materials between the offshore platform 10 and the wellhead 18, while the BOP 16 may include at least one BOP stack having at least one valve with a sealing element to control wellbore fluid flows. In some embodiments, the riser string 12 may pass through an opening (e.g., a moonpool) in the offshore platform 10 and may be coupled to drilling equipment of the offshore platform 10. As illustrated in FIG. 1, it may be desirable to have the riser string 12 positioned in a vertical orientation between the wellhead 18 and the offshore platform 10 to allow a drill string made up of drill pipes 20 to pass from the offshore platform 10 through the BOP 16 and the wellhead 18 and into a wellbore below the wellhead 18. Also illustrated in FIG. 1 is a drilling rig 22 (e.g., a drilling package or the like) that may be utilized in the drilling and/or servicing of a wellbore below the wellhead 18.

Figure 2:
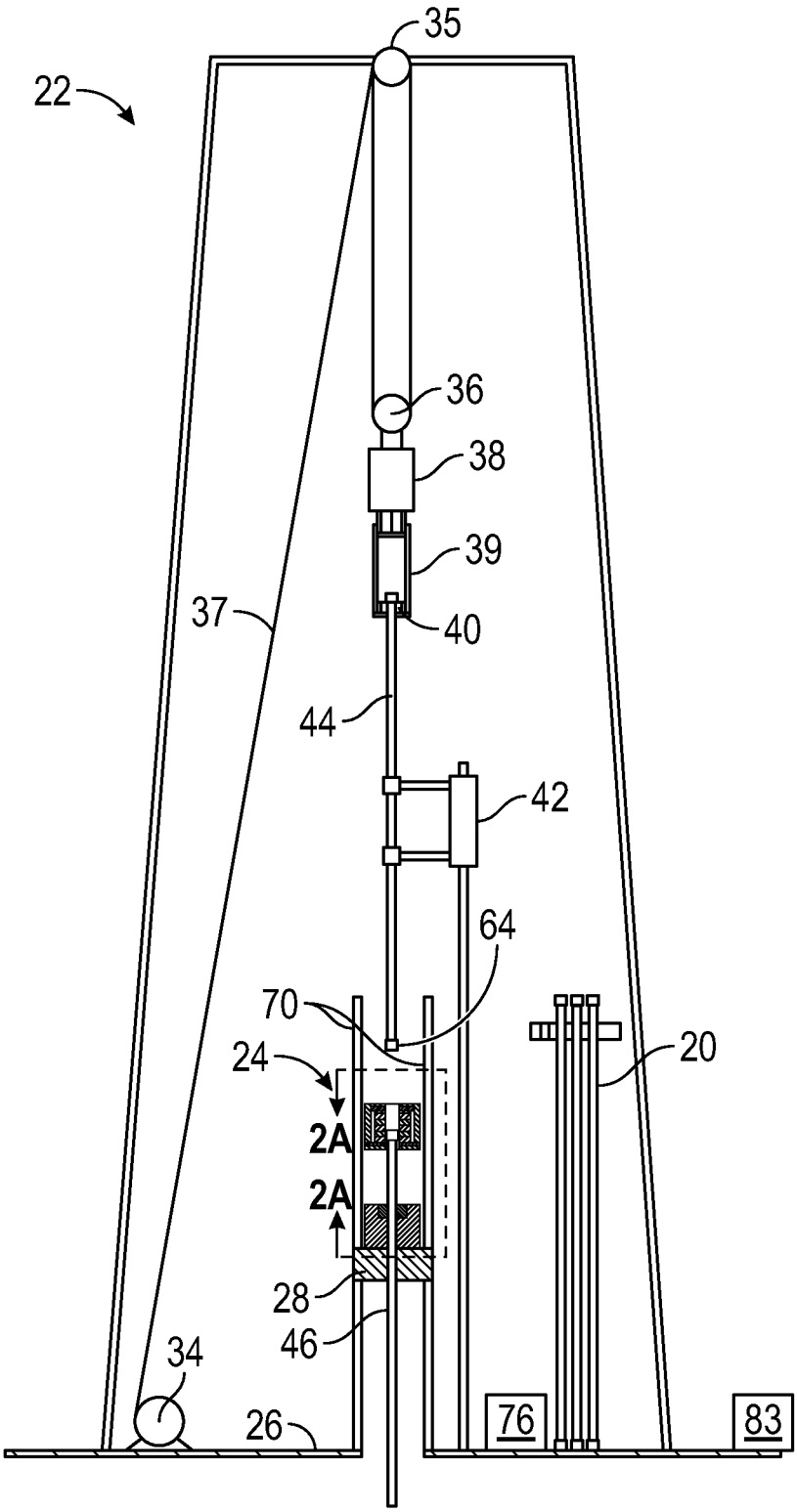
FIG. 2 illustrates a front view a drill rig as illustratively presented in FIG. 1, in accordance with an embodiment.
Figure 3:
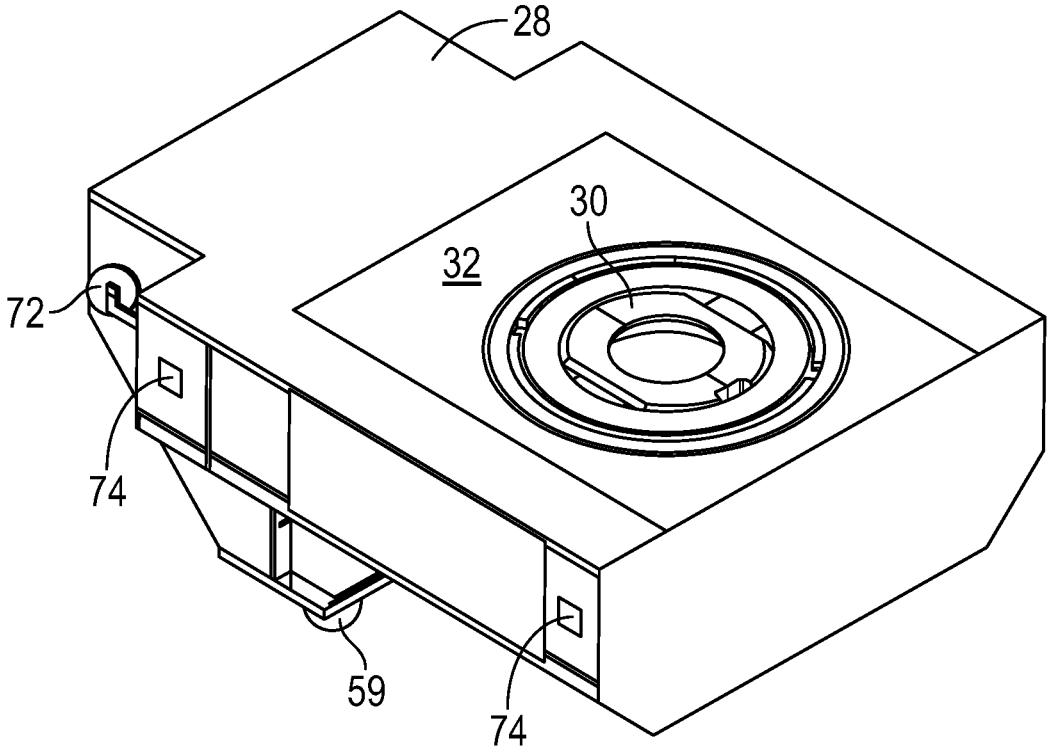
FIG. 3 illustrates an isometric view of a movable platform of FIG. 2, in accordance with an embodiment.

In a tripping operation consistent with embodiments of the present disclosure, as depicted in FIG. 2, a tripping apparatus 24 is illustrated as being positioned above drill floor 26 in the drilling rig 22 above the wellbore (e.g., the drilled hole or borehole of a well which may be proximate to the drill floor 26 or which may be, in conjunction with FIG. 1, below the wellhead 18). However, as will be discussed in greater detail below, the tripping apparatus may be moved towards and away from the drill floor 26 during a tripping operation. As illustrated, the drilling rig 22 may include one or more of, for example, the tripping apparatus 24, a movable platform 28 (that may include floor slips 30 positioned in rotary table 32, as illustrated in FIG. 3), drawworks 34, a crown block 35, a travelling block 36, a top drive 38, an elevator 40 that may support bails 39 (e.g., elevator links), and a tubular handling apparatus 42. The tripping apparatus 24 may operate to couple and decouple tubular segments (e.g., couple and decouple drill pipe 20 to and from a drill string) while the floor slips 30 may operate to close upon and hold a drill pipe 20 and/or the drill string passing into the wellbore. The rotary table 32 may be a rotatable portion that can locked into positon co-planar with the drill floor 26 and/or above the drill floor 26. The rotary table 32 can, for example, operate to impart rotation to the drill string either as a primary or a backup rotation system (e.g., a backup to the top drive 38) as well as utilize its floor slips 30 to support tubular segments, for example, during a tripping operation.

The drawworks 34 may be a large spool that is powered to retract and extend drilling line 37 (e.g., wire cable) over a crown block 35 (e.g., a vertically stationary set of one or more pulleys or sheaves through which the drilling line 37 is threaded) and a travelling block (e.g., a vertically movable set of one or more pulleys or sheaves through which the drilling line 37 is threaded) to operate as a block and tackle system for movement of the top drive 38, the elevator 40, and any tubular segment (e.g., drill pipe 20) coupled thereto. In some embodiments, the top drive 38 and/or the elevator 40 (along with any associated bails 39) may be referred to as a tubular support system or the tubular support system may also include the block and tackle system described above.

The top drive 38 may be a device that provides torque to (e.g., rotates) the drill string as an alternative to the rotary table 32 and the elevator 40 may be a mechanism that may be closed around a drill pipe 20 or other tubular segments (or similar components) to grip and hold the drill pipe 20 or other tubular segments while those segments are moving vertically (e.g., while being lowered into or raised from a wellbore) or directionally (e.g., during slant drilling). The tubular handling apparatus 42 (e.g., a column racker) may operate to retrieve a tubular segment (e.g., a drill pipe 20) from a storage location (e.g., a pipe stand) and position the tubular segment during tripping-in to assist in adding a tubular segment to a tubular string. Likewise, the tubular handling apparatus 42 may operate to retrieve a tubular segment 44 from a tubular string and transfer the tubular segment 44 to a storage location (e.g., a pipe stand) during tripping-out to remove the tubular segment 44 from the tubular string. In some embodiments, the tubular segment 44 and tubular segment 46 may include multiple segments of drill pipe 20 (e.g., three drill pipe 20 segments coupled to one another).

Figure 2A:
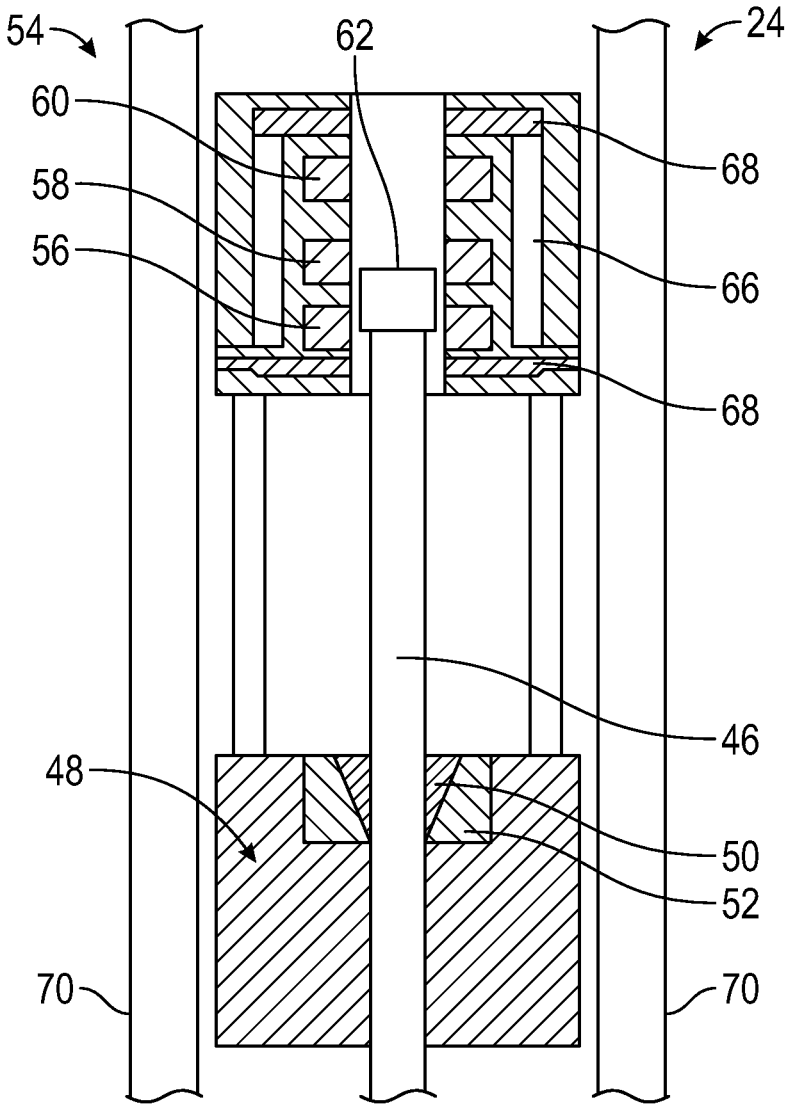
FIG. 2A illustrates a front view of the tripping apparatus of FIG. 2, in accordance with an embodiment.

During a tripping-in operation, the tubular handling apparatus 42 may position a tubular segment 44 (e.g., a drill pipe 20) so that the tubular segment 44 may be grasped by the elevator 40 (or its respective bails 39). Elevator 40 may be lowered, for example, via the block and tackle system towards the tripping apparatus 24 to be coupled to tubular segment 46 (e.g., a drill pipe 20) as part of a drill string. As illustrated in FIG. 2A, the tripping apparatus 24 may include tripping slips 48 inclusive of slip jaws 50 that engage and hold the segment 46 as well as a forcing ring 52 that operates to provide force to actuate the slip jaws 50. The tripping slips 48 may, thus, be activated to grasp and support the segment, and, accordingly, an associated tubular string (e.g., drill string) when the tubular string is disconnected from block and tackle system. The tripping slips 48 may be actuated hydraulically, electrically, pneumatically, or via any similar technique. In some embodiments, the tripping slips 48 may be omitted and the floor slips 30 may be used in place of the tripping slips 48. Likewise, the tripping slips 48 may, in some embodiments, be used in combination with the floor slips 30.

The tripping apparatus 24 may further include a roughneck 54 that may operate to selectively make-up and break-out a threaded connection between tubular segments 44 and 46 in a tubular string. In some embodiments, the roughneck 54 may include one or more of fixed jaws 56, makeup/breakout jaws 58, and a spinner 60. In some embodiments, the fixed jaws 56 may be positioned to engage and hold the (lower) tubular segment 46 below a threaded joint 62 thereof. In this manner, when the (upper) tubular segment 44 is positioned coaxially with the tubular segment 46 in the tripping apparatus 24, the tubular segment 46 may be held in a stationary position to allow for the connection of the tubular segment 44 and the tubular segment 46 (e.g., through connection of the threaded joint 62 of the tubular segment 46 and a threaded joint 64 of the tubular segment 44).

To facilitate this connection, the spinner 60 and the makeup/breakout jaws 58 may provide rotational torque. For example, in making up the connection, the spinner 60 may engage the tubular segment 44 and provide a relatively high-speed, low-torque rotation to the tubular segment 44 to connect the tubular segment 44 to the tubular segment 46. Likewise, the makeup/breakout jaws 58 may engage the tubular segment 44 and may provide a relatively low-speed, high-torque rotation to the tubular segment 44 to provide, for example, a rigid connection between the tubular segments 44 and 46. Furthermore, in breaking-out the connection, the makeup/breakout jaws 58 may engage the tubular segment 44 and impart a relatively low-speed, high-torque rotation on the tubular segment 44 to break the rigid connection. Thereafter, the spinner 60 may provide a relatively high-speed, low-torque rotation to the tubular segment 44 to disconnect the tubular segment 44 from the tubular segment 46.

In some embodiments, the roughneck 54 may further include a mud bucket 66 that may operate to capture drilling fluid, which might otherwise be released during, for example, the break-out operation. In this manner, the mud bucket 66 may operate to prevent drilling fluid from spilling onto drill floor 26. In some embodiments, the mud bucket 66 may include one or more seals 68 that aid in fluidly sealing the mud bucket 66 as well as a drain line that operates to allow drilling fluid contained within mud bucket 66 to return to a drilling fluid reservoir.

The roughneck 54 may be movable towards and away from the drill floor 26 and, in some embodiments, relative to the tripping slips 48. Movement of the roughneck 54 may be accomplished through the use of hydraulic pistons, jack-screws, racks and pinions, cable and pulley, a linear actuator, or the like. This movement may be beneficial to aid in proper location of the roughneck 54 during a make-up or break-out operation (e.g., during a tripping-in or tripping-out operation).

Returning to FIG. 2, the movable platform 28, may be raised and lowered with a cable and sheave arrangement (e.g., similar to the block and tackle system for movement of the top drive 38) that may include a winch or other drawworks element positioned on the drill floor 26 or elsewhere on the offshore platform 10 or the drilling rig 22. The winch or other drawworks element may be a spool that is powered to retract and extend line (e.g., a wire cable or drilling line 37) over a crown block (e.g., a stationary set of one or more pulleys or sheaves through which the drilling line 37 is threaded) and a travelling block (e.g., a movable set of one or more pulleys or sheaves through which the drilling line 37 is threaded) to operate as a block and tackle system for movement of the movable platform 28 and, thus the rotary table 32 therein and the tripping apparatus 24 thereon. Additionally and/or alternatively, direct acting cylinders, a suspended winch and cable system mechanism disposed such that the movable platform 28 is between the and the suspended winch and cable system and the drill floor 26, or similar internal or external actuation systems may be used to move the movable platform along support element 70.

In some embodiments, the support element 70 may be one or more guide mechanisms (e.g., guide tracks, such as top drive dolly tracks) so that provide support (e.g., lateral support) to the movable platform 28 while allowing for movement towards and away from the drill floor 26. Additionally, as illustrated in FIG. 3, one or more lateral supports 72 may be used to couple the movable platform to the support element 70. For example, the lateral supports 72 may be, for example, pads that may be made of Teflon-graphite material or another low-friction material (e.g., a composite material) that allows for motion of the movable platform 28 relative to drill floor 26 and/or the tubular segment support system with reduced friction characteristics. In addition to, or in place of the aforementioned pads, other lateral supports 72 including bearing or roller type supports (e.g., steel or other metallic or composite rollers and/or bearings) may be utilized. The lateral supports 72 may allow the movable platform 28 to interface with a support element 70 (e.g., guide tracks, such as top drive dolly tracks) so that the movable platform 28 is movably coupled to the support element 70. Accordingly, the movable platform 28 may be movably coupled a support element 70 to allow for movement of the movable platform 28 (e.g., towards and away from the drill floor 26 and/or the tubular segment support system while maintaining contact with the guide tracks or other support element 70) during a tripping operation (e.g., a continuous tripping operation).

As further illustrated in FIG. 3, the movable platform 28 may have guide pins 59 or similar devices to provide coarse and fine alignment when moving in and out of the drill floor 26 (e.g., into a planar position with the drill floor 26 or raised above the drill floor 26). Additionally, one or more locking mechanisms may be employed to affix the movable platform 28 into a desired position with respect to the drill floor 26, for example, when a tripping operation is complete or not necessary. In this fixed position, the rotary table 32 may operate in conjunction with the top drive 38 and/or as a backup system to the top drive 38. The locking elements 74 may be automatic (e.g., controllable) such that they can be actuated without human contact (e.g., a control signal may cause pins or other locking mechanisms to engage an aperture between the drill floor 26 and the movable platform 28). It is envisioned that the locking elements 74 will interface with a raised platform on the drill floor 26 (if the movable platform 28 is to be locked in a position above the drill floor 26, e.g., planar to the raised platform thereon) or the locking elements may interface with the drill floor 26 or an element beneath the drill floor (if the movable platform 28 is to be locked in a position planar with the drill floor 26).

Figure 3A:
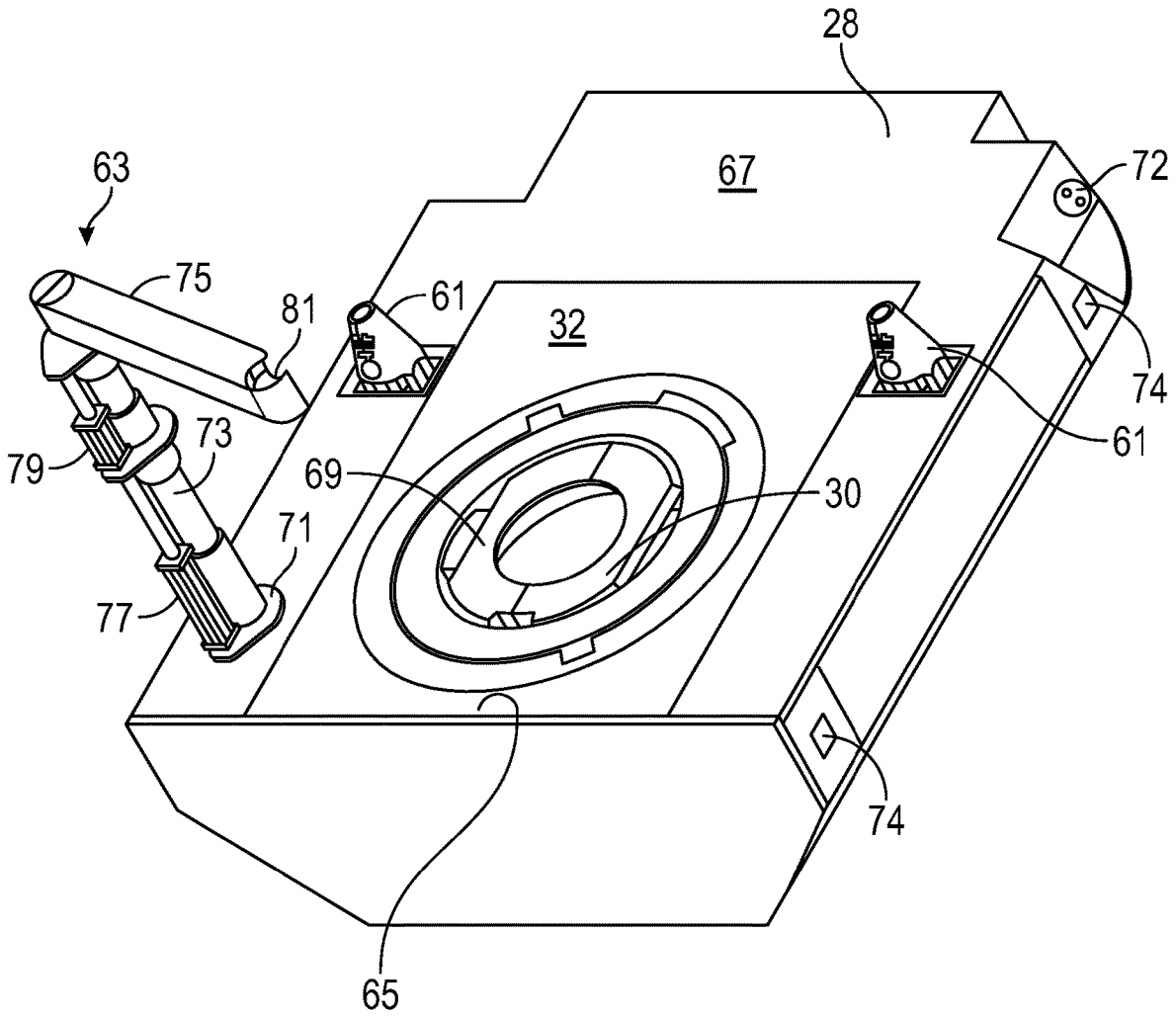
FIG. 3A illustrates an isometric view of the movable platform of FIG. 2 having a support member, in accordance with an embodiment.

FIG. 3A illustrates a second embodiment of the movable platform 28. As illustrated, the movable platform 28 may additionally include one or more cable attachments 61 that operate to connect the movable platform to cables utilized to aid in the movement of the movable platform 28. Additionally, the movable platform 28 may include a support member 63 (e.g., pipe support member or a tubular segment support member) that operates to hold (i.e., support) the tubular segment 44 in connection with the movement of the movable platform 28. The support member 63 may operate to move the supported tubular segment, for example, in a direction from a first position 65 (i.e., a storage position) at an edge of an upper face 67 of the movable platform 28, across the upper face 67 of the movable platform 28, and to a second position 69 (e.g., a deployment position) at a central region of the upper face 67 of the movable platform 28 so as to position the tubular segment 44 for connection with a second tubular segment 46. In this manner, the support member 63 may impart lateral movement to the tubular segment 44 that is perpendicular in direction to the movement of the movable platform 28.

In some embodiments, the support member 63 may include a base 71 disposed on the upper face 67 of the movable platform 28. The base 71 may be coupled to a vertical support 73, such as one or more segments of pipe, which may operate to provide support to an arm 75, such as a stabbing arm. Disposed along the support 73 may be an actuation system 77, such as a hydraulic cylinder or hydraulic piston, a linear actuator, or the like, that allows for the arm 75 to be moved in a direction towards and away from the upper face 67 of the movable platform 28. Additionally, actuation system 79 may be disposed along the support 73 and may allow for the arm 75 to be moved directionally across the face 67 of the movable platform 28. The arm 75 may further include a receptacle 81. The receptacle 81 may include one or more support walls and a base that together may hold a portion of the tubular segment 44 (e.g., a pin end of the tubular segment 44). The one or more support walls of the receptacle 81 may circumferentially surround or partially circumferentially surround the base of the receptacle 81 and may provide lateral support to the tubular segment 44 when a portion of the tubular segment 44 is disposed in the receptacle 81. Similarly, the base of the receptacle 81 may provide vertical support to the tubular segment 44 when a portion of the tubular segment 44 is disposed in the receptacle 81. In some embodiments, an aperture may be disposed in the one or more support walls of the receptacle 81 so as to allow a pathway for the tubular segment to more easily be removed from the receptacle 81.

Returning to FIG. 2, a computing system 76 may be present and may operate in conjunction with one or more of the tripping apparatus 24, the movable platform 28, an actuating system used to move the tripping apparatus 24, and/or an actuating system used to move the movable platform 28. This computing system 76 may also operate to control one or more of the tubular segment support system and/or the tubular handling apparatus 42. It should be noted that the computing system 76 may be a standalone unit (e.g., a control monitor). However, in some embodiments, the computing system 76 may be communicatively coupled to a separate main control system 83, for example, a control system in a driller's cabin that may provide a centralized control system for drilling controls, automated pipe handling controls, and the like. In other embodiments, the computing system 76 may be a portion of the main control system 83 (e.g., the control system present in the driller's cabin).

Figure 4:
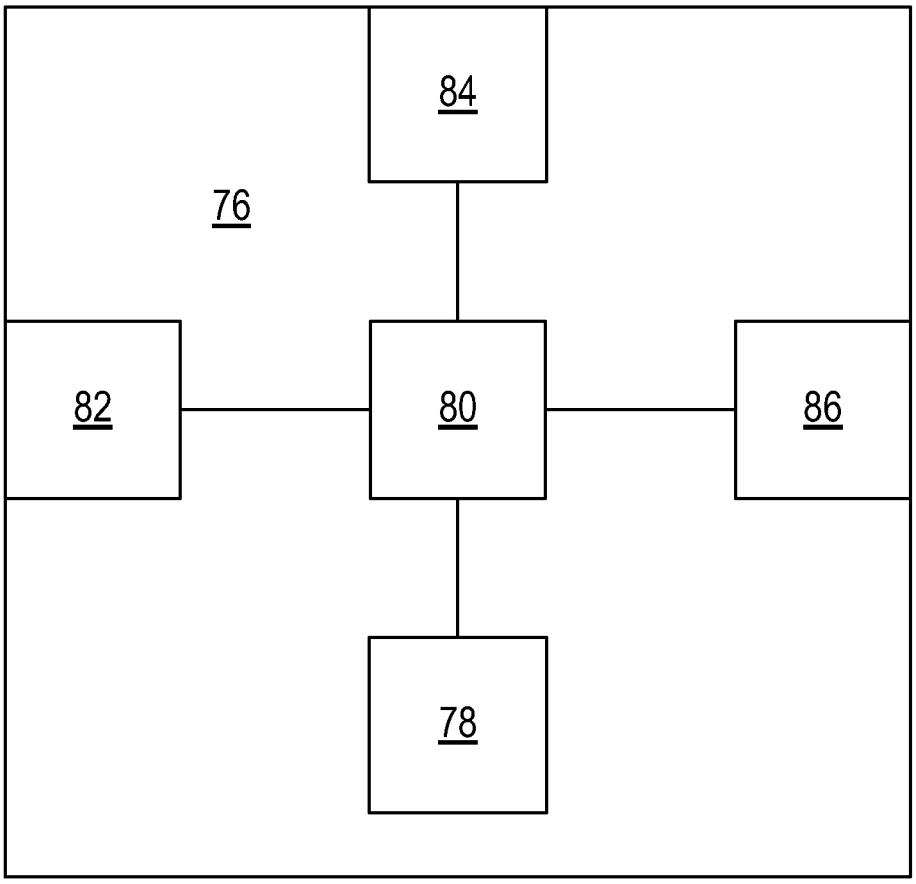
FIG. 4 illustrates a block diagram of a computing system of FIG. 2, in accordance with an embodiment.

An example of the computing system 76 is illustrated in FIG. 4. The computing system 76 may operate in conjunction with software systems implemented as computer executable instructions stored in a non-transitory machine readable medium of computing system 76, such as memory 78, a hard disk drive, or other short term and/or long term storage. Particularly, the techniques to described below with respect to tripping operations may be accomplished, for example, using code or instructions stored in a non-transitory machine readable medium of computing system 76 (such as memory 78) and may be executed, for example, by a processing device 80 or a controller of computing system 76 to control the previously described elements of FIGS. 2, 2A, and 3 during tripping operations.

Thus, the computing system 76 may be a general purpose or a special purpose computer that includes a processing device 80, such as one or more application specific integrated circuits (ASICs), one or more processors, or another processing device that interacts with one or more tangible, non-transitory, machine-readable media (e.g., memory 78) of the computing system 76 that collectively stores instructions executable by the processing device 80 to perform the methods and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processing device 80. In some embodiment, the instructions executable by the processing device 80 are used to generate, for example, control signals to be transmitted to, for example, one or more of the tripping apparatus 24 (e.g., the roughneck 54 and/or one or more of the fixed jaws 56, the makeup/breakout jaws 58, and the spinner 60), the tubular handling apparatus 42, the movable platform 28, the tubular segment support system, and/or ancillary elements related thereto for use in conjunction with a tripping operation.

The computing system 76 may also include one or more input structures 82 (e.g., one or more of a keypad, mouse, touchpad, touchscreen, one or more switches, buttons, or the like) to allow a user to interact with the computing system 76, for example, to start, control, or operate a graphical user interface (GUI) or applications running on the computing system 76 and/or to start, control, or operate, for example, one or more of the tripping apparatus 24 (e.g., the roughneck 54 and/or one or more of the fixed jaws 56, the makeup/breakout jaws 58, and the spinner 60), the tubular handling apparatus 42, the movable platform 28, the tubular segment support system, and/or ancillary elements related thereto for use in conjunction with a tripping operation. Additionally, the computing system 76 may include a display 84 that may be a liquid crystal display (LCD) or another type of display that allows users to view images generated by the computing system 76. The display 84 may include a touch screen, which may allow users to interact with the GUI of the computing system 76. Likewise, the computing system 76 may additionally and/or alternatively transmit images to a display of a main control system, which itself may also include a non-transitory machine readable medium, such as memory 78, a processing device 80, one or more input structures 82, a display 84, and/or a network interface 86.

As may be appreciated, the above referenced GUI may be a type of user interface that allows a user to interact with the computing system 76 and/or the computing system 76 and one or more sensors (e.g., the control system) through, for example, graphical icons, visual indicators, and the like. Additionally, the computing system 76 may include network interface 86 to allow the computing system 76 to interface with various other devices (e.g., electronic devices). The network interface 86 may include one or more of a Bluetooth interface, a local area network (LAN) or wireless local area network (WLAN) interface, an Ethernet or Ethernet based interface (e.g., a Modbus TCP, EtherCAT, and/or ProfiNET interface), a field bus communication interface (e.g., Profibus), a/or other industrial protocol interfaces that may be coupled to a wireless network, a wired network, or a combination thereof that may use, for example, a multi-drop and/or a star topology with each network spur being multi-dropped to a reduced number of nodes.

In some embodiments, one or more of the tripping apparatus 24 (and/or a controller or control system associated therewith), the tubular handling apparatus 42 (and/or a controller or control system associated therewith), the movable platform 28 (and/or a controller or control system associated therewith), the tubular segment support system (and/or a controller or control system associated therewith), and/or ancillary elements related thereto (and/or a controller or control system associated therewith) for use in conjunction with a tripping operation may each be a device that can be coupled to the network interface 86. In some embodiments, the network formed via the interconnection of one or more of the aforementioned devices should operate to provide sufficient bandwidth as well as low enough latency to exchange all required data within time periods consistent with any dynamic response requirements of all control sequences and closed-loop control functions of the network and/or associated devices therein. It may also be advantageous for the network to allow for sequence response times and closed-loop performances to be ascertained, the network components should allow for use in oilfield/drillship environments (e.g., should allow for rugged physical and electrical characteristics consistent with their respective environment of operation inclusive of but not limited to withstanding electrostatic discharge (ESD) events and other threats as well as meeting any electromagnetic compatibility (EMC) requirements for the respective environment in which the network components are disposed). The network utilized may also provide adequate data protection and/or data redundancy to ensure operation of the network is not compromised, for example, by data corruption (e.g., through the use of error detection and correction or error control techniques to obviate or reduce errors in transmitted network signals and/or data).

Figure 5:
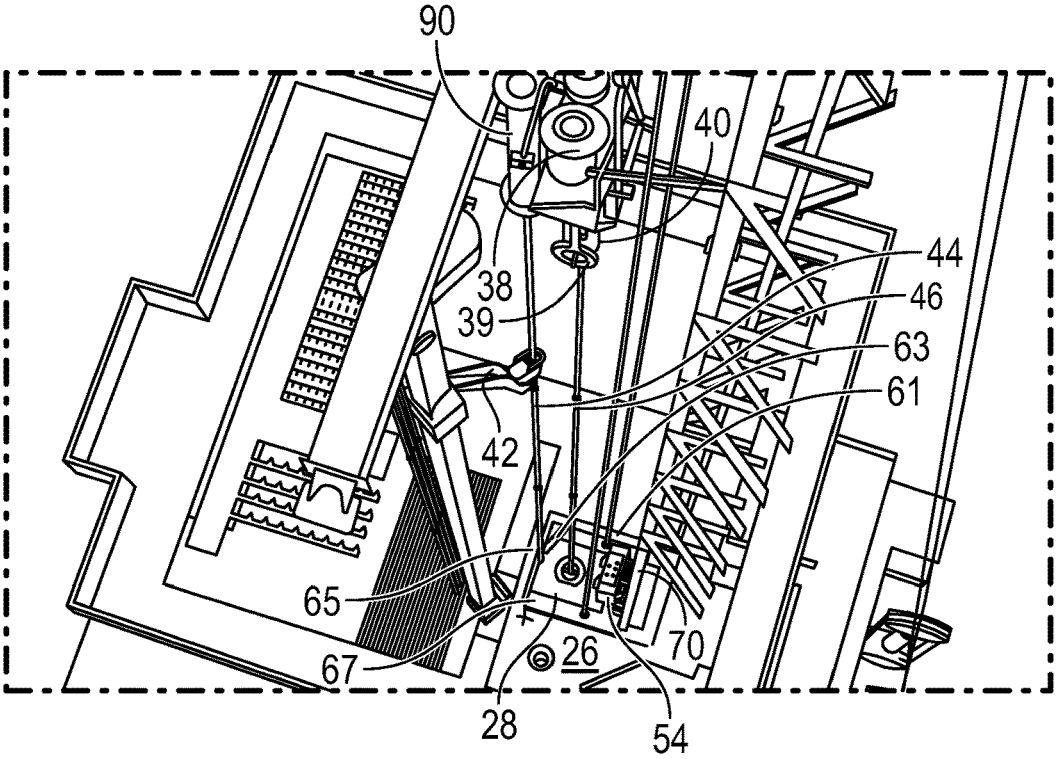
FIG. 5 illustrates a first view of the movable platform of FIG. 3A in a tripping operation, in accordance with an embodiment.

A tripping operation, for example, controllable by the computing system 76, will be discussed in greater detail with respect to FIGS. 5-14. Turning to FIG. 5, the movable platform 28 is illustrated in a locked position planar with the drill floor 26. As illustrated, two wires 88 (although more or fewer wires 88 may be used) are coupled to the movable platform 28, for example, via cable attachments 61. The wires 88 and may operate to move the movable platform 28 in conjunction with a cable and sheave arrangement (e.g., similar to the block and tackle system for movement of the top drive 38) that may include a winch or other drawworks element positioned on the drill floor 26 or elsewhere on the offshore platform 10 or the drilling rig 22. Likewise, internal or external actuation systems, such as hydraulic cylinders or hydraulic piston, linear actuators, or the like may be used in addition to or in place of the aforementioned movement systems to move the movable platform 28 along support element 70.

As illustrated, the movable platform 28 may include the support member 63, which may be part of a tubular segment support system. Additionally, in some embodiments, from a tubular segment support system may include a guide member 90. The guide member 90 may be positioned in line with a first position 65 (i.e., a storage position) at an edge of an upper face 67 of the movable platform 28. The guide member 90 may operate as a restriction element of the tubular segment 44 by restricting movement of the tubular segment 44 (i.e., lateral movement across the upper face 67 of the movable platform) distinct from any lateral movement imparted by support member 63 or movement imparted by the movable platform 28. That is, the guide member 90 may provide lateral support and/or restrict lateral movement of an upper portion of the tubular segment 44.

In some embodiments, the guide member 90 may cylindrically surround or partially surround the tubular segment 44 and, for example, may include apertures (in a top and bottom region of the guide member 90) that allow for the tubular segment to pass through the guide member 90. In one embodiment, the guide member 90 may be disposed on or otherwise coupled to the top drive 38 to allow for movement of the guide member 90 in conjunction with the top drive 38. The connection to the top drive 38 may be fixed. Alternatively, the guide member 90 may be extendable laterally towards and away from the top drive 38 via, for example, a retractable arm or other mechanism that operates to maintain the guide member 90 as being disposed above (e.g., in line with) the support member 63 (e.g., the receptacle 81) as the support member moves between the first position 65 (i.e., the storage position) at an edge of an upper face 67 of the movable platform 28 and the second position 69 (e.g., the deployment position) at a central region of the upper face 67 of the movable platform 28 so as to position the tubular segment 44 for connection with a second tubular segment 46. In this manner, the guide member 90 may continue to provide lateral support and/or prevent lateral movement (e.g., prevent lateral movement of the tubular segment 44 that exceeds, for example, approximately 3 in., 6 in., 12 in., 18 in., 24 in., or another value) of an upper portion of the tubular segment 44 relative to the portion of the tubular segment 44 disposed in the receptacle 81 (i.e., the guide member may keep an upper portion of the tubular segment 44 in line or otherwise disposed generally in line with a lower portion of the tubular segment 44, which may be disposed in the receptacle 81).

Illustrated in FIG. 5 is a step in a tripping operation (as illustrated, a tripping-in operation), in which the tubular handling apparatus 42 may position a tubular segment 44 to be supported by the support member 63. For example, the tubular handling apparatus 42 may insert the tubular segment 44 into the receptacle 81 so that the support member 63 may operate to support the tubular segment 44. As illustrated, this positioning of the tubular segment 44 may additionally align the tubular segment 44 with the guide member 90 (i.e., the tubular segment 44 may be placed into a lower aperture of the guide member 90 or the tubular segment may be positioned in line with and between the guide member 90 and the movable platform 28.

Figure 6:
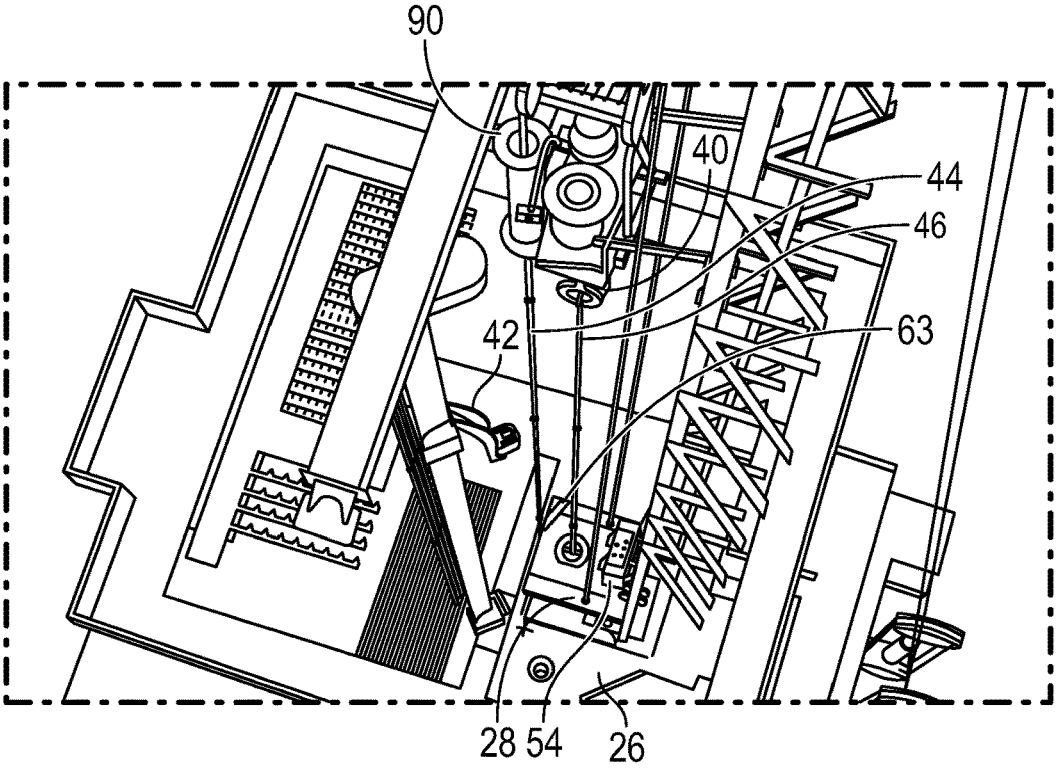
FIG. 6 illustrates a second view of the movable platform of FIG. 3A in the tripping operation, in accordance with an embodiment.

In FIG. 6, the tubular handling apparatus 42 may rotate in a direction away from the edge of the upper face 67 of the movable platform 28. Likewise, a block and tackle system or other system for movement of the top drive 38, the elevator 40, and, in the illustrated embodiment, the tubular segment 46, may begin to move the top drive 38, the elevator 40, and the tubular segment 46 towards the movable platform 28. The movable platform 28 may, concurrently, begin to move away from the drill floor 26. As illustrated, the tubular segment 44 may pass through an upper aperture of the guide member 90 as the top drive 38 is moved towards the movable platform 28. However, the guide member 90 may still provide lateral support to the tubular segment and/or restrict lateral movement of a second portion of the tubular segment 44 away (i.e., a portion of the tubular segment 44 away from a terminal end of the tubular segment 44, which is disposed in the receptacle 81).

Figure 7:
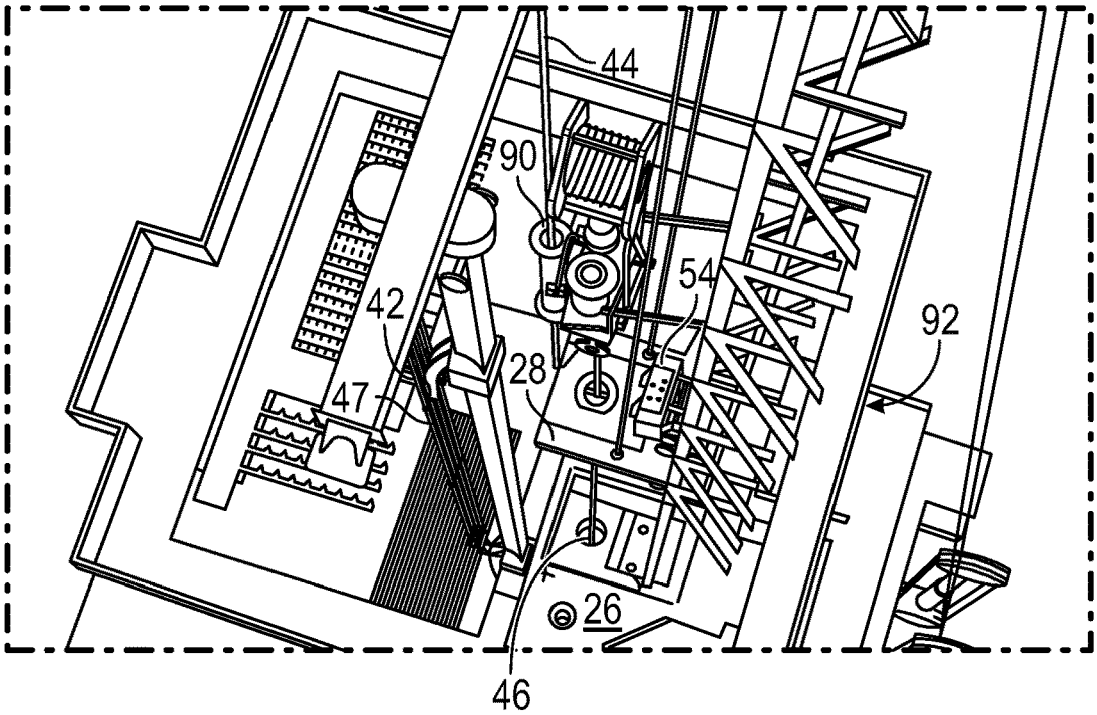
FIG. 7 illustrates a third view of the movable platform of FIG. 3A in the tripping operation, in accordance with an embodiment.
Figure 8:
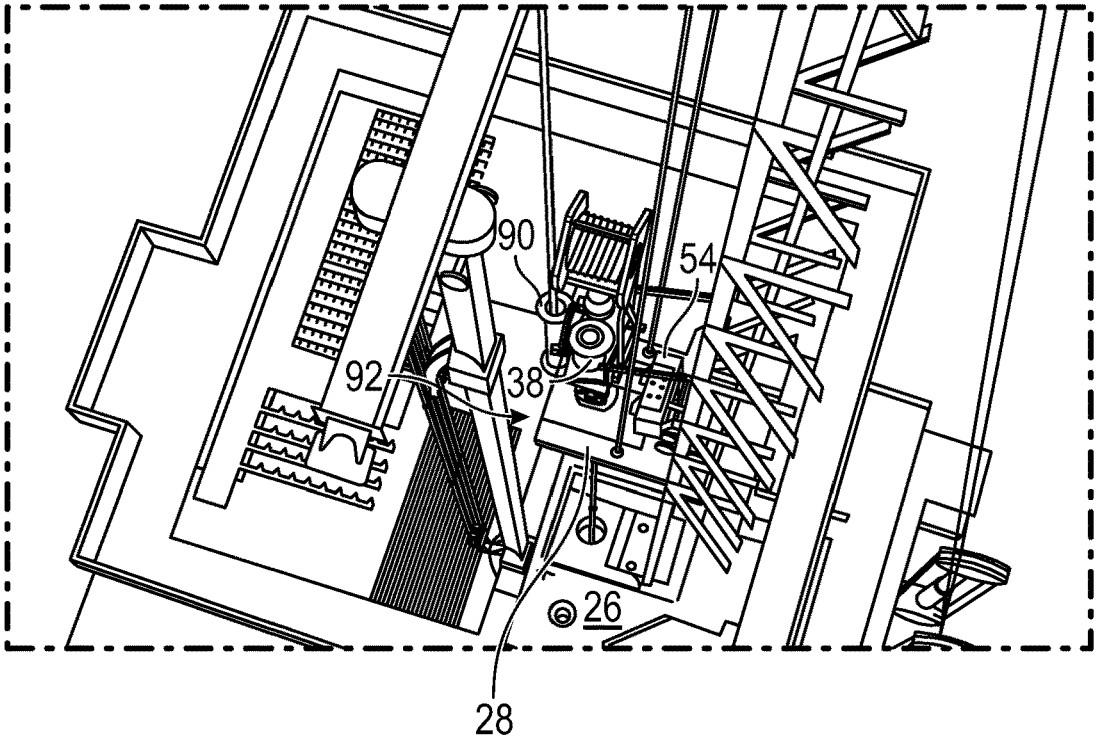
FIG. 8 illustrates a fourth view of the movable platform of FIG. 3A in the tripping operation, in accordance with an embodiment.
Figure 9:
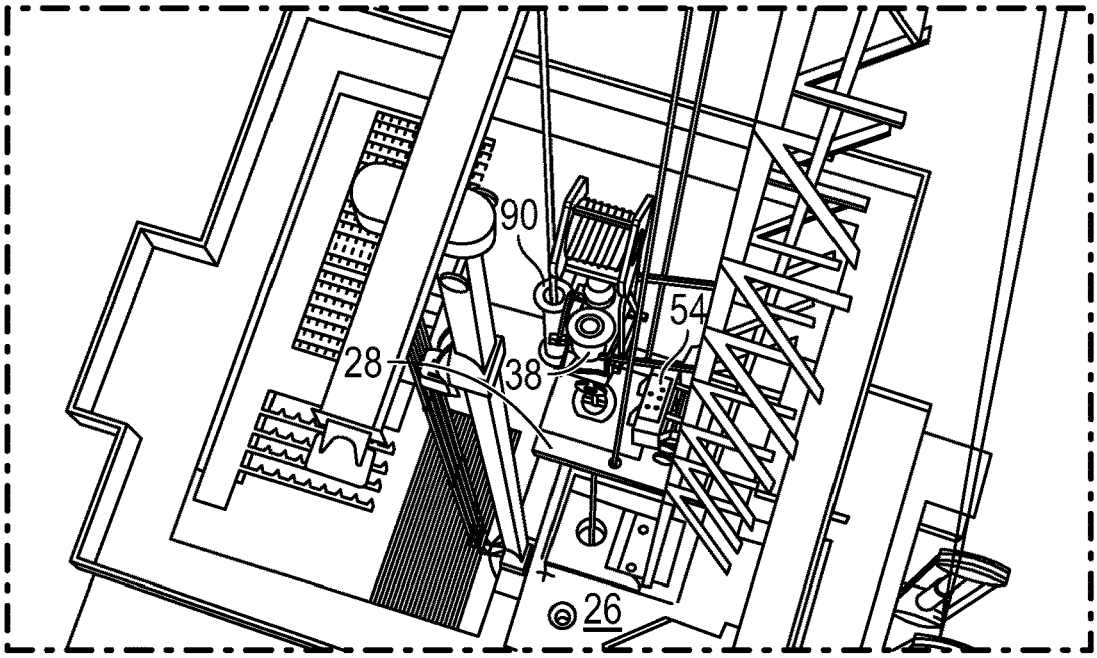
FIG. 9 illustrates a fifth view of the movable platform of FIG. 3A in the tripping operation, in accordance with an embodiment.
Figure 10:
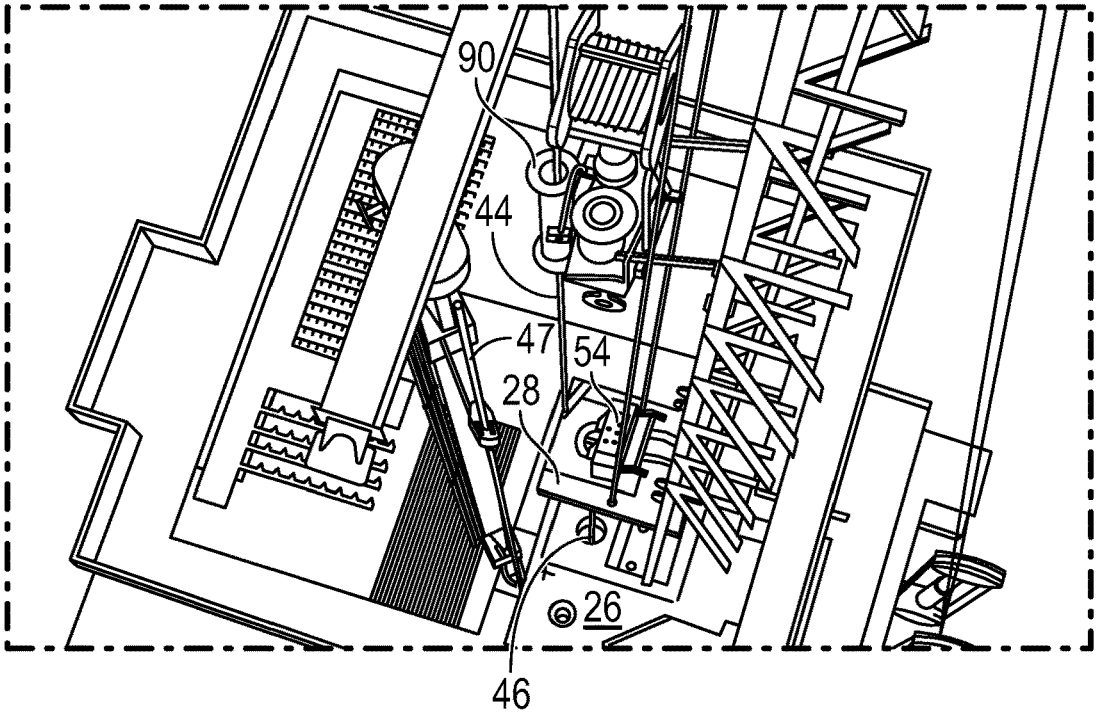
FIG. 10 illustrates a sixth view of the movable platform of FIG. 3A in the tripping operation, in accordance with an embodiment.

FIG. 7 illustrates the movable platform 28 moving towards an upper position at height 92. Concurrently, the block and tackle system supporting tubular segment 46 lowers tubular segment 46 towards the wellbore as the elevator 40 moves towards height 92. As additionally illustrated in FIG. 7, the tubular handling apparatus 42 may retrieve an additional tubular segment 47 from a storage location (e.g., a pipe stand). In some embodiments, the tubular segment 47 may include multiple segments of drill pipe 20 (e.g., three drill pipe 20 segments coupled to one another). In FIG. 8, the movable platform 28 is illustrated as being disposed at the upper position at height 92. Likewise, the block and tackle system supporting tubular segment 46 has lowered tubular segment 46 towards the wellbore so that the threaded joint 62 at a terminal end of the tubular segment 46 is disposed adjacent to the roughneck 54. As elevator 40 lowers tubular segment 46, floor slips 30 may actuate and grasp tubular segment 46 while the elevator 40 releases the tubular segment 46. Subsequently, as illustrated in FIG. 9, the roughneck 54 may move across the movable platform 28 and into position adjacent the threaded joint 62 while the movable platform 28, as further illustrated in FIG. 10, continues to move the tubular segment 46 towards the wellbore as the block and tackle system is utilized to move the elevator 40, top drive 38 (and, accordingly, the guide member 90) away from the drill floor 26. As additionally illustrated in FIG. 10, the tubular handling apparatus 42 may rotate the retrieved tubular segment 47 from the storage location into a position adjacent to the drill floor 26 where the movable platform 28 was originally disposed (e.g., in FIG. 5).

Figure 11:
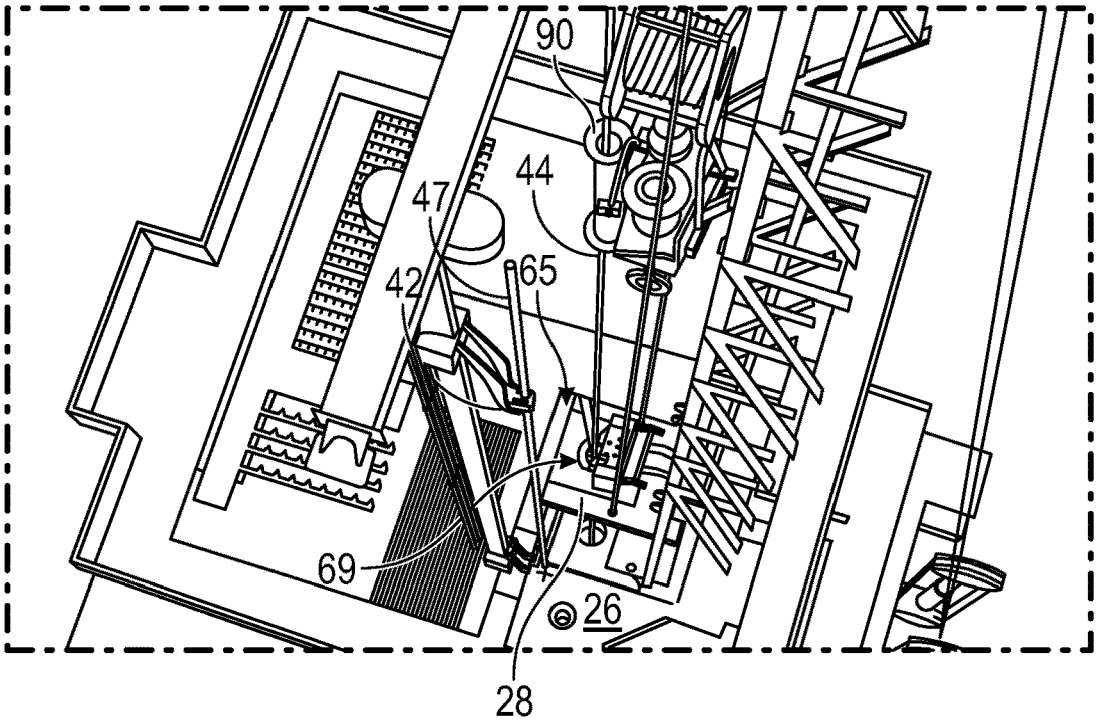
FIG. 11 illustrates a seventh view of the movable platform of FIG. 3A in the tripping operation, in accordance with an embodiment.

FIG. 11 illustrates continued movement of the movable platform 28 towards the drill floor 26. Additionally, the elevator 40, top drive 38 (and, accordingly, the guide member 90) may be moved in conjunction with the movement of the support member 63 in a direction from the first position 65 (i.e., a storage position) at an edge of an upper face 67 of the movable platform 28, across the upper face 67 of the movable platform 28, and to the second position 69 (e.g., a deployment position) at a central region of the upper face 67 of the movable platform 28 so as to position the tubular segment 44 for connection with a second tubular segment 46. In this manner, the support member 63 may impart lateral movement to the tubular segment 44 that is perpendicular in direction to the movement of the movable platform 28 and the guide member 90 may be moved in conjunction with the movement of the support member 63 so as to continue to provide lateral support and/or restrict lateral movement of an upper portion of the tubular segment 44. In some embodiments, the movement of the support member 63 may be concurrent with the block and tackle system moving the elevator 40, top drive 38 (and, accordingly, the guide member 90) away from the drill floor 26. Alternatively, the elevator 40, top drive 38 (and, accordingly, the guide member 90) may already be located in their uppermost position away from the drill floor 26 in FIG. 11 so that only the lateral movement to allow the guide member 90 to move in conjunction with the movement of the support member 63 occurs. In conjunction with FIG. 11, the roughneck 54 may operate to make-up a threaded connection between tubular segments 44 and 46 in a tubular string. In this manner, the (upper) tubular segment 44 may be positioned coaxially with the tubular segment 46 in the tripping apparatus 24, and the support of the lower portion of the tubular segment 44 may be transferred to the tripping apparatus 24 or a portion thereof, for example, to the roughneck 54, to complete the making-up of the tubular segment 44 and the tubular segment 46.

Figure 12:
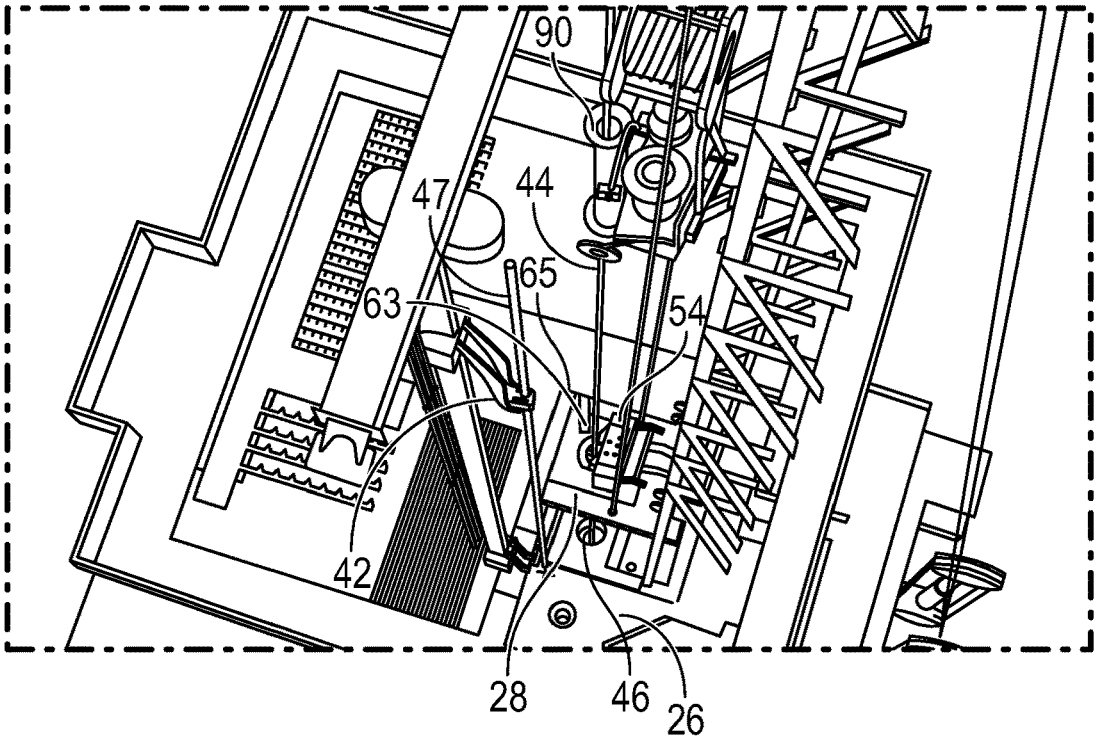
FIG. 12 illustrates an eighth view of the movable platform of FIG. 3A in the tripping operation, in accordance with an embodiment.

FIG. 12 illustrates the making-up of the tubular segment 44 and the tubular segment 46 by the roughneck 54 as the movable platform 28 continues its movement towards the drill floor 26. At this time, the coupling of tubular segment 44 and 46 is performed by the tripping apparatus 24, as previously described in conjunction with FIG. 2A above. For example, during this coupling process, tripping slips 48 inclusive of slip jaws 50 of the roughneck 54 engage and hold the tubular segment 46. The roughneck 54 may operate to make-up a threaded connection between tubular segments 44 and 46 in a tubular string. As previously noted, the roughneck 54 may include one or more of fixed jaws 56, makeup/breakout jaws 58, and a spinner 60. The fixed jaws 56 may be positioned to engage and hold the (lower) tubular segment 46 below a threaded joint 62 thereof. In this manner, when the (upper) tubular segment 44 is positioned coaxially with the tubular segment 46 in the tripping apparatus 24 (as illustrated in FIG. 12), the tubular segment 46 may be held in a stationary position to allow for the connection of the tubular segment 44 and the tubular segment 46 (e.g., through connection of the threaded joint 62 of the tubular segment 46 and a threaded joint 64 of the tubular segment 44).

As illustrated, the support member 63, no longer supporting the tubular segment 44, moves in a direction towards the first position 65 (i.e., the storage position) at the edge of an upper face 67 of the movable platform 28, from the second position 69 (e.g., the deployment position) at a central region of the upper face 67 at which the roughneck 54 is making up the tubular segment 44 and the tubular segment 46. Also illustrated in FIG. 12 is the movement of the bails 39 and elevator 40 into a position in line with (e.g., directly above) the second position 69 (e.g., the deployment position) at a central region of the upper face 67 at which the roughneck 54 is making up the tubular segment 44 and the tubular segment 46. Once in this position, the bails 39 will be available to close upon the tubular segment 44.

Figure 13:
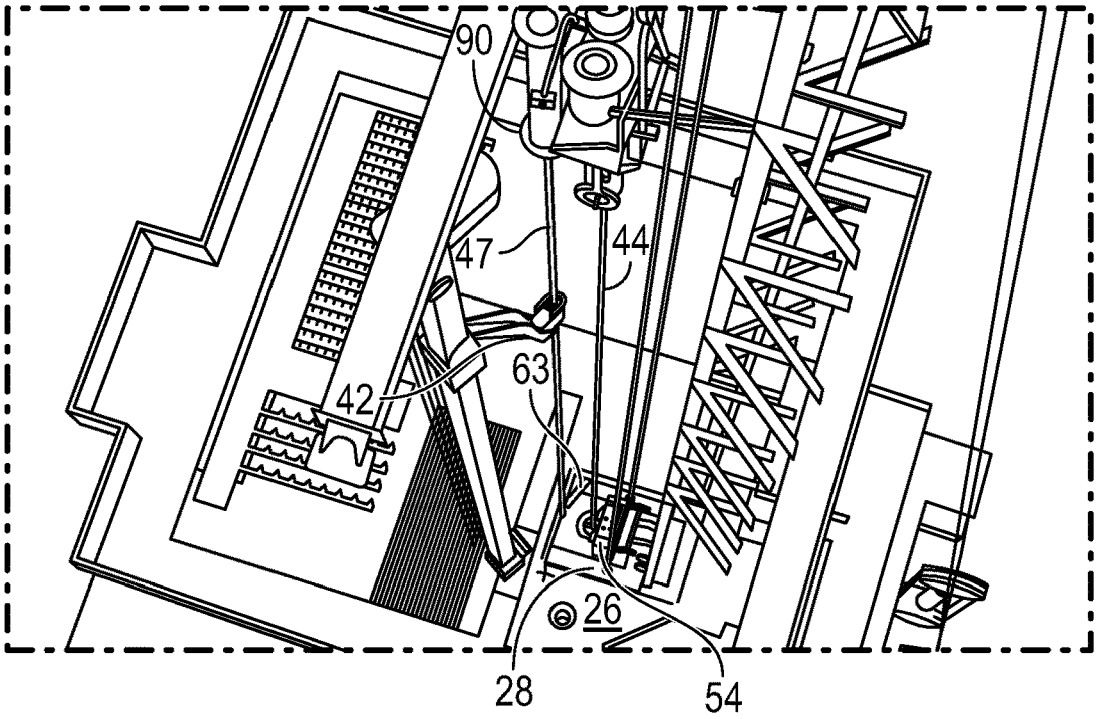
FIG. 13 illustrates a ninth view of the movable platform of FIG. 3A in the tripping operation, in accordance with an embodiment.

FIG. 13 illustrates the positioning of the top drive 38 in line with the bails 39 and the elevator 40 at a position in line with (e.g., directly above) the second position 69 (e.g., the deployment position) at a central region of the upper face 67. At this stage in the tripping-in operation, the roughneck 54 and the floor slips 30 release connections with tubular segment 44 and tubular segment 46 so that the tubular support system may operate to close upon, hold, and support the drill string passing into the wellbore. The support member 63 has moved fully to the first position 65 at the edge of an upper face 67 of the movable platform 28. The tubular handling apparatus 42 moves across the upper face 67 of the movable platform and disposes the tubular segment 47 into the receptacle 81 of the support member 63. As illustrated in FIG. 13, the movable platform 28 may be disposed at its lowest position, for example, flush with the drill floor 26 (e.g., where the movable platform 28 was originally disposed in FIG. 5). As further illustrated, the block and tackle system may operate to move the top drive 38, the elevator 40, and the tubular segment 46 coupled thereto towards the drill floor 25, causing the drill string to move towards the wellbore. This movement also causes the guide member 90 (now realigned with the first position 65 at an edge of an upper face 67 of the movable platform 28 to accept an upper portion of the tubular segment 47 though a lower aperture of the guide member 90 so as to operate as a restriction element of the tubular segment 47 by restricting movement of the tubular segment 47 (i.e., lateral movement across the upper face 67 of the movable platform) distinct from any lateral movement imparted by support member 63 or movement imparted by the movable platform 28. That is, the guide member 90 may provide lateral support and/or restrict lateral movement of an upper portion of the tubular segment 47.

Figure 14:
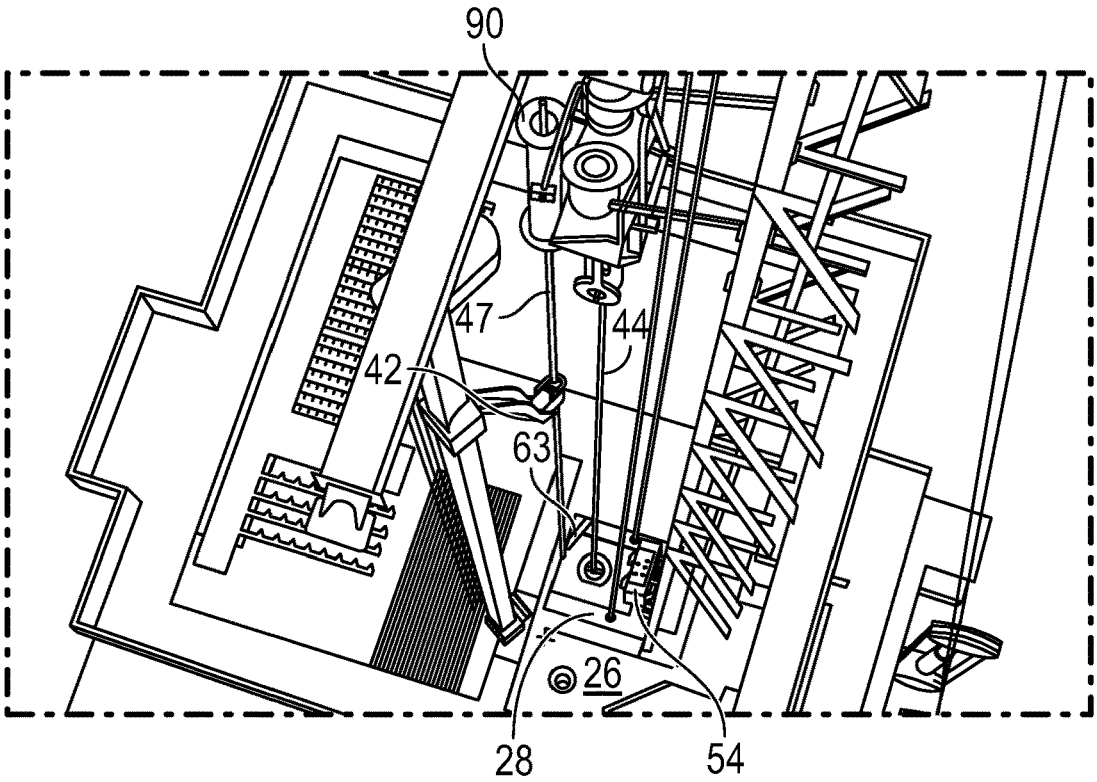
FIG. 14 illustrates a tenth view of the movable platform of FIG. 3A in the tripping operation, in accordance with an embodiment.

FIG. 14 illustrates removal of the roughneck 54 moved back into its storage location away from the second position 69 and at an edge of the upper face of the movable platform 28 opposite from the support member 63. Similarly, the support member 63 is disposed in the first position 65 at the edge of an upper face 67 of the movable platform 28. At this stage of the tripping-in operation, the movable platform 28 moves away from the drill floor 26 while the block and tackle system may operate to move the top drive 38, the elevator 40, and the tubular segment 46 towards the drill floor 26, to continue the tripping-in operation in the manner discussed above. Likewise, it should be appreciated that the steps described above may be reversed to allow for a tripping-out operation to occur.

Figure 15:
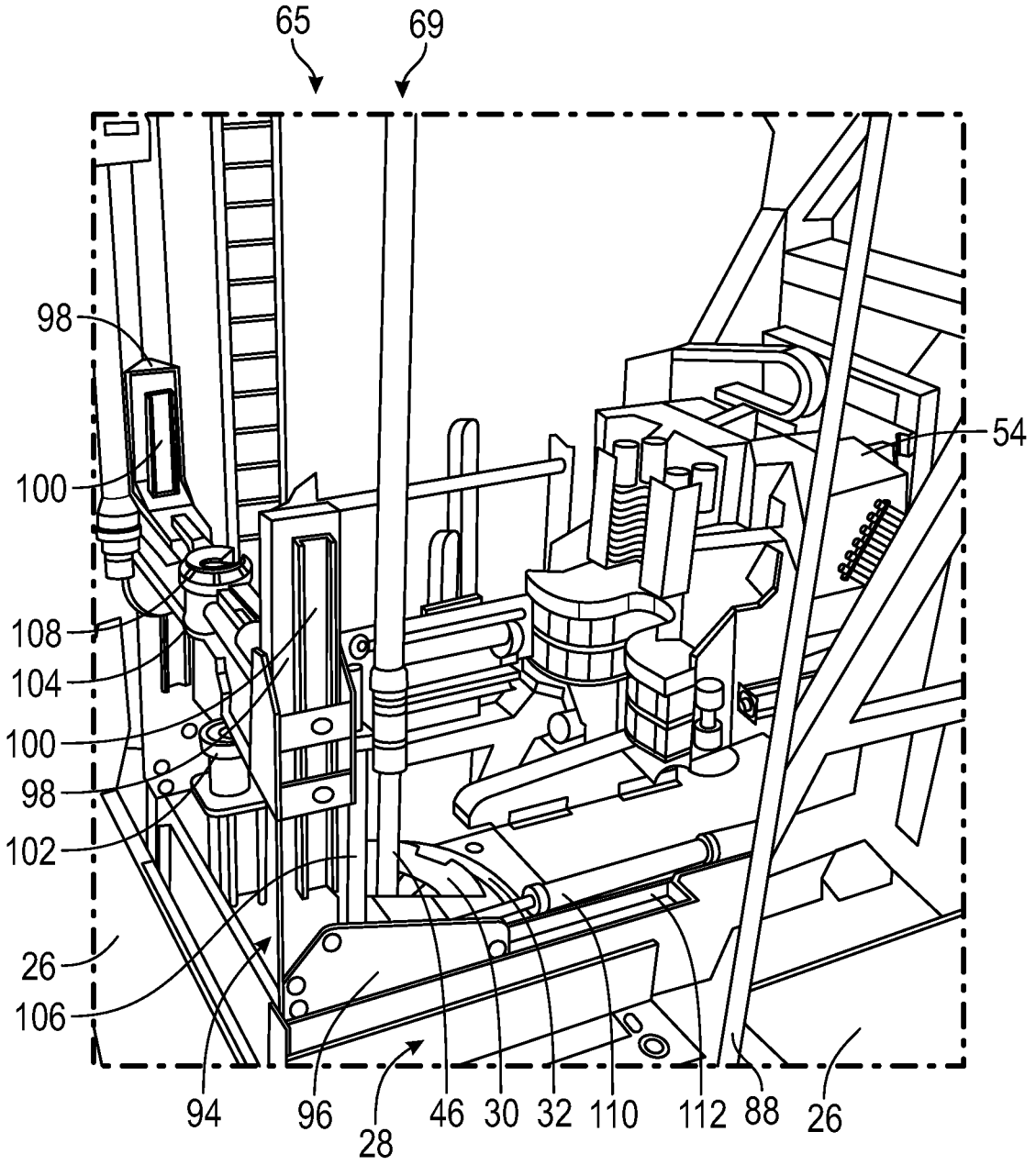
FIG. 15 illustrates a first view of the movable platform of FIG. 3 having a second embodiment of a support member in a second tripping operation, in accordance with an embodiment.

In some embodiments, the support member 63 and/or the guide member 90 illustrated above may be substituted or replaced. For example, FIG. 15 illustrates a support member 94 disposed on the movable platform 28 which may be used in place of the previously described support member 63. The support member 94 (e.g., pipe support member or a tubular segment support member) that operates to hold (i.e., support) the tubular segment 44, tubular segment 47, or other segments in connection with the movement of the movable platform 28. The support member 94 may operate to move the supported tubular segment, for example, in a direction from the first position 65 (i.e., a storage position) at an edge of an upper face 67 of the movable platform 28, across the upper face 67 of the movable platform 28, and to the second position 69 (e.g., a deployment position) at a central region of the upper face 67 of the movable platform 28 so as to position the tubular segment 44 for connection with a second tubular segment 46. In this manner, the support member 94 may impart lateral movement to the tubular segment 44 that is perpendicular in direction to the movement of the movable platform 28.

In some embodiments, the support member 94 may include a base 96 disposed on the upper face 67 of the movable platform 28. The base 96 may be coupled to a vertical support arm 98, which may have a guide 100 (e.g., a track) disposed thereon. In some embodiments, an additional vertical support arm 98 may be disposed on an opposite side of the base 96. The base also may have a receptacle 102 or the receptacle 102 may be separately affixed to the movable platform 28. The receptacle 102 may include one or more support walls and a base that together may hold a portion of a tubular segment 44 (e.g., a pin end of the tubular segment 44 or another segment). The one or more support walls of the receptacle 102 may circumferentially surround or partially circumferentially surround the base of the receptacle 102 and may provide lateral support to the tubular segment 44 when a portion of the tubular segment 44 is disposed in the receptacle 102. Similarly, the base of the receptacle 102 may provide vertical support to the tubular segment 44 when a portion of the tubular segment 44 is disposed in the receptacle 102. In some embodiments, an aperture may be disposed in the one or more support walls of the receptacle 102 so as to allow a pathway for the tubular segment to more easily be removed from the receptacle 81. The receptacle 102 may disposed between a first vertical support arm 98 and a second vertical support arm 98.

Additionally, the support member 94 may include a movable support 104 disposed between a first vertical support arm 98 and a second vertical support arm 98 that spans the distance between the first vertical support arm 98 and the second vertical support arm 98. In some embodiments, the movable support 104 may be movably coupled to the first vertical support arm 98 and the second vertical support arm 98 via the respective guides 100 of the first vertical support arm 98 and the second vertical support arm 98, such that the movable support 104 is movable, for example, towards and away from the movable platform 28 while remaining in a fixed lateral position relative to the first vertical support arm 98 and the second vertical support arm 98. An actuator 106, such as a hydraulic cylinder or hydraulic piston, a linear actuator, or the like, may be coupled to the movable support 104 and/or the first vertical support arm 98 and the second vertical support arm 98 and may operate to move the movable support 104 towards and away from the movable platform 28. The movable support 104 may additionally include one or more slips 108 or other constriction elements may actuate and grasp tubular segment 44 when it is disposed in the movable support 104.

The support member 94 may further include an actuator 110. The actuator 110 may be coupled to the base 96 and/or the vertical arm 98. In some embodiments, an actuator 110 may be coupled to each of the first vertical support arm 98 and the second vertical support arm 98. The actuator 110 may be a hydraulic cylinder or hydraulic piston, a linear actuator, or the like and may operate to control movement of the support member 94 towards and away from the rotary table 32. Thus, the actuator 110 operates to control the movement of the support member 94 across the upper face 67 of the movable platform 28 between the first position 65 (i.e., a storage position) at the edge of the upper face 67 of the movable platform 28 and the second position 69 (e.g., a deployment position) at a central region of the upper face 67 of the movable platform 28. To aid in accomplishing this movement, the support member 94 may slide along a guide 112 (e.g., a track) disposed on the upper face 67 of the movable platform 28, which may coupled to, for example, the base 96 of the support member 94.

Figure 16:
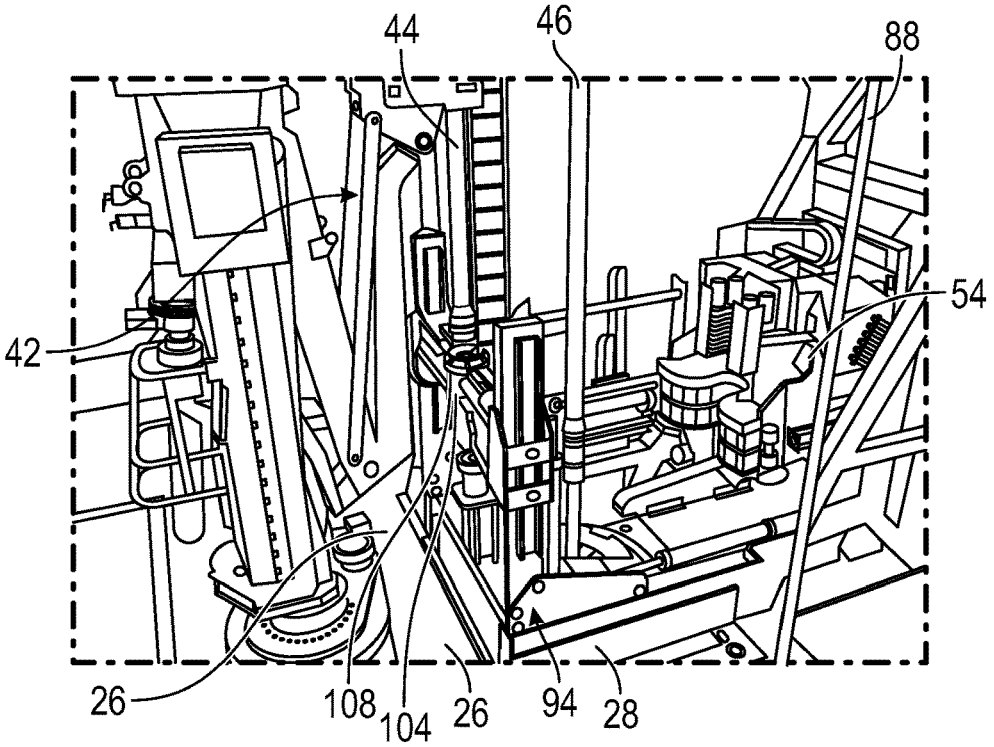
FIG. 16 illustrates a second view of the movable platform of FIG. 15 in the second tripping operation, in accordance with an embodiment.

A tripping operation, for example, controllable by the computing system 76, will be discussed in greater detail with respect to FIGS. 15-25. Turning to FIG. 16, the movable platform 28 is illustrated in a locked position planar with the drill floor 26. As illustrated, a wire 88 (although more wires 88 may be used) is coupled to the movable platform 28. The wire 88 may operate to move the movable platform 28 in conjunction with a cable and sheave arrangement (e.g., similar to the block and tackle system for movement of the top drive 38) that may include a winch or other drawworks element positioned on the drill floor 26 or elsewhere on the offshore platform 10 or the drilling rig 22. Likewise, internal or external actuation systems, such as hydraulic cylinders or the like may be used in addition to or in place of the aforementioned movement systems to move the movable platform 28 along support element 70.

Illustrated in FIG. 16 is a step in a tripping operation (as illustrated, a tripping-in operation), in which the tubular handling apparatus 42 may position a tubular segment 44 to be supported by the support member 94. For example, the tubular handling apparatus 42 may insert the tubular segment 44 through an aperture in the movable support 104 that is surrounded by the slips 108. As illustrated, the support member is disposed in the first position 65 and the tubular segment 46 may be passing through the floor slips 30 towards the wellbore (e.g., supported by the top drive 38, the elevator 40 and moved via the block and tackle system described above).

Figure 17:
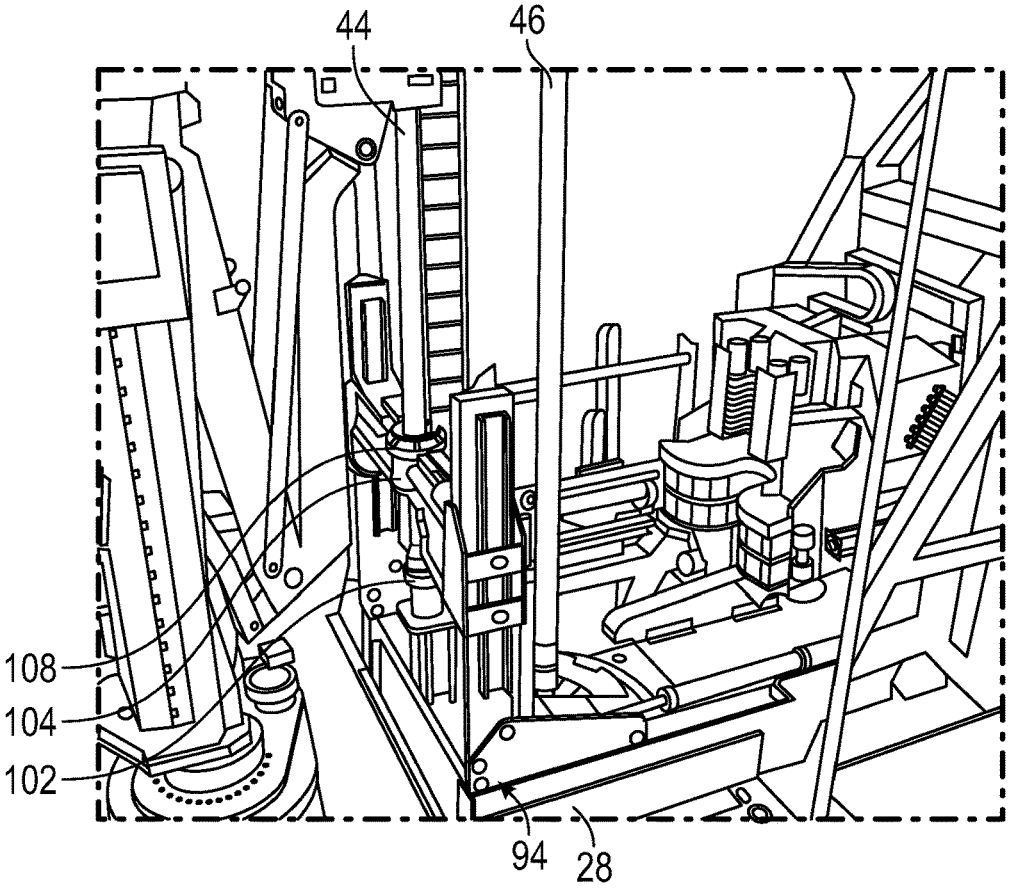
FIG. 17 illustrates a third view of the movable platform of FIG. 15 in the second tripping operation, in accordance with an embodiment.

FIG. 17 illustrates the positioning and release of the tubular segment 44 into the receptacle 102. At this time, the tubular handling apparatus 42 may release the tubular segment and may rotate away from the movable platform 28. Additionally, the slips 108 may enclose the tubular segment 44 to provide additional restriction of lateral movement by the tubular segment 44 and/or additional vertical support tubular segment 44. The tubular segment 46 may continue to be passing through the floor slips 30 towards the wellbore (e.g., supported by the top drive 38, the elevator 40 and moved via the block and tackle system described above).

Figure 18:
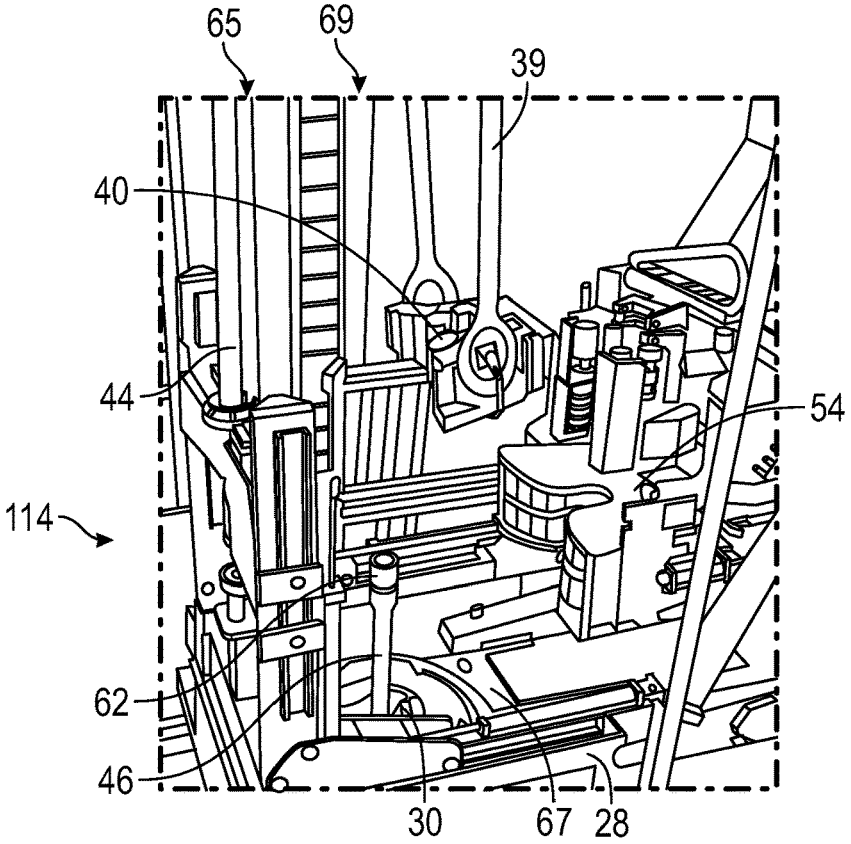
FIG. 18 illustrates a fourth view of the movable platform of FIG. 15 in the second tripping operation, in accordance with an embodiment.

FIG. 18 illustrates a subsequent step in the tripping operation to that illustrated in FIG. 17 in which the movable platform 28 is moving away from the drill floor 26 as the block and tackle system supporting tubular segment 46 lowers tubular segment 46 towards the wellbore so that the threaded joint 62 at a terminal end of the tubular segment 46 is disposed adjacent to the roughneck 54 for example, at height 114 (e.g., the uppermost distance between the movable platform 28 and the drill floor 26). When the movable platform 28 reaches height 114, slips 30 may enclose and grip the tubular segment 46 (e.g., to support the tubular segment 46 as well as and drill string beneath tubular segment 46), the elevator 40 may release the tubular segment 46 (i.e., the top drive 38 transfers the drill string load to the rotary table 32), and the bails 39 and elevator 40 may be retracted away from the movable platform 28, as illustrated in FIG. 18. As the rotary table 32 receives the drill string load, the movable platform 28 may transition from moving away from the drill floor 26 to moving towards the drill floor 26. Additionally at the step, in some embodiments, the tubular handling apparatus 42 may retrieve an additional tubular segment 47 from a storage location (e.g., a pipe stand). In some embodiments, the tubular segment 47 may include multiple segments of drill pipe 20 (e.g., three drill pipe 20 segments coupled to one another).

Figure 19:
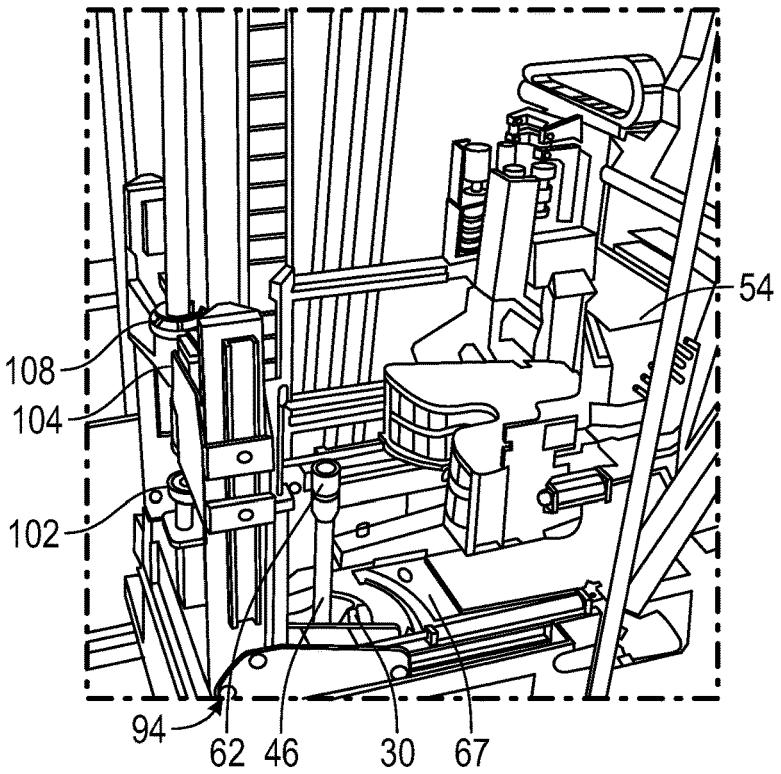
FIG. 19 illustrates a fifth view of the movable platform of FIG. 15 in the second tripping operation, in accordance with an embodiment.

FIG. 19 illustrates a subsequent step in the tripping operation subsequent to that illustrated in FIG. 18, whereby the roughneck 54 is vertically positioned (e.g., vertically aligned with respect to the threaded joint 62) during the movement of the movable platform 28 towards the drill floor 26. During the vertical positioning of the roughneck 54 (or once complete), the roughneck 54 may move across the movable platform 28 and into position adjacent the threaded joint 62. Likewise, the movable support 104 may begin to raise the tubular segment 44 out of the receptacle 102, as illustrated in FIG. 19. The slips 108 may vertically support at least the bottom portion of the tubular segment 44 as the movable support 104 moves away from the movable platform 28. As previously noted, this movement may be accomplished via the actuator 106 and the actuator 106 may operate to raise the tubular segment 44 to a height such that the terminal end of the tubular segment 44 is disposed above the threaded joint 62 with respect to the movable platform 28.

Figure 20:
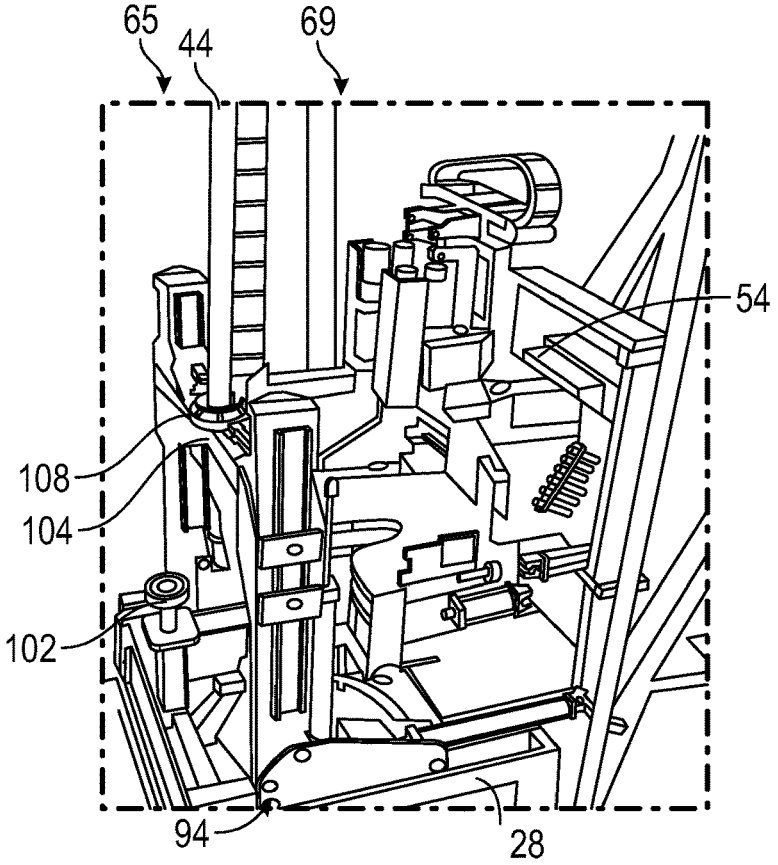
FIG. 20 illustrates a sixth view of the movable platform of FIG. 15 in the second tripping operation, in accordance with an embodiment.

FIG. 20 illustrates a subsequent step in the tripping operation subsequent to that illustrated in FIG. 19, whereby the tubular segment 44 is fully separated from the receptacle 102 as the support member 94 moves from the first position 65 (i.e., a storage position) at the edge of the upper face 67 of the movable platform 28 towards the second position 69 (e.g., a deployment position) at the central region of the upper face 67 of the movable platform 28. As previously discussed, this movement may be accomplished via the actuator 110. Likewise, the roughneck 54 is illustrated as moving towards the second position 69 in FIG. 20.

Figure 21:
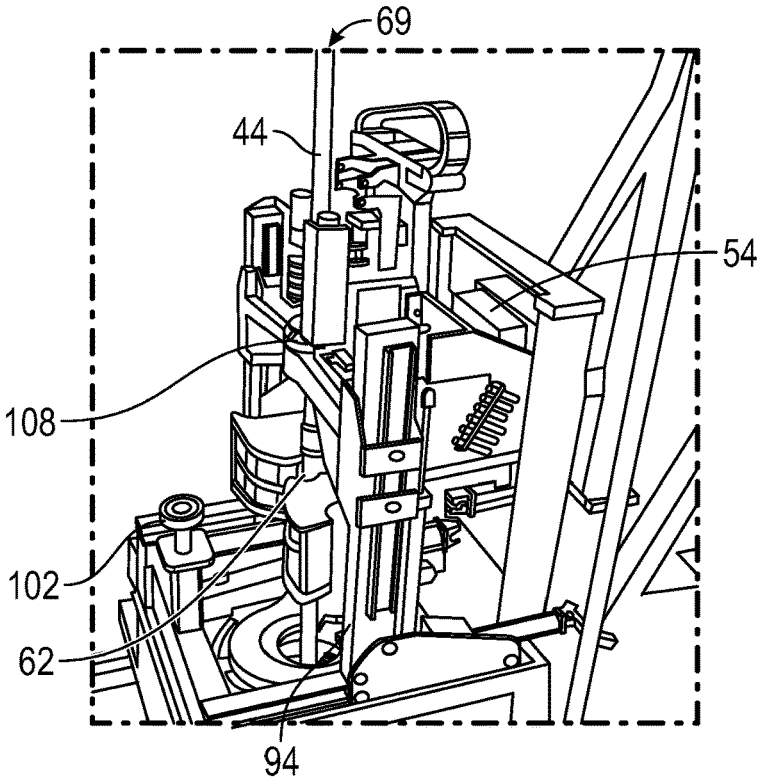
FIG. 21 illustrates a seventh view of the movable platform of FIG. 15 in the second tripping operation, in accordance with an embodiment.

FIG. 21 illustrates a subsequent step in the tripping operation subsequent to that illustrated in FIG. 20, whereby the making-up of the tubular segment 44 and the tubular segment 46 by the roughneck 54 is accomplished as the movable platform 28 continues its movement towards the drill floor 26. In some embodiments, when both the roughneck 54 and the support member 94 have moved into the second position 69 (deployment position), the movable support 104 may move towards the movable platform 28 to position the terminal end (e.g., a pin end) of the tubular segment 44 directly adjacent to the threaded joint 62 of the tubular segment 46. This movement may be accomplished via the actuator 106.

At this time, the coupling of tubular segment 44 and 46 is performed by the tripping apparatus 24, as previously described in conjunction with FIG. 2A above. For example, during this coupling process, tripping slips 48 inclusive of slip jaws 50 engage and hold the tubular segment 46. The roughneck 54 may operate to make-up a threaded connection between tubular segments 44 and 46 in a tubular string. As previously noted, the roughneck 54 may include one or more of fixed jaws 56, makeup/breakout jaws 58, and a spinner 60. The fixed jaws 56 may be positioned to engage and hold the (lower) tubular segment 46 below a threaded joint 62 thereof. In this manner, when the (upper) tubular segment 44 is positioned coaxially with the tubular segment 46 in the tripping apparatus 24 (as illustrated in FIG. 21), the tubular segment 46 may be held in a stationary position to allow for the connection of the tubular segment 44 and the tubular segment 46 (e.g., through connection of the threaded joint 62 of the tubular segment 46 and a threaded joint 64 of the tubular segment 44).

Figure 22:
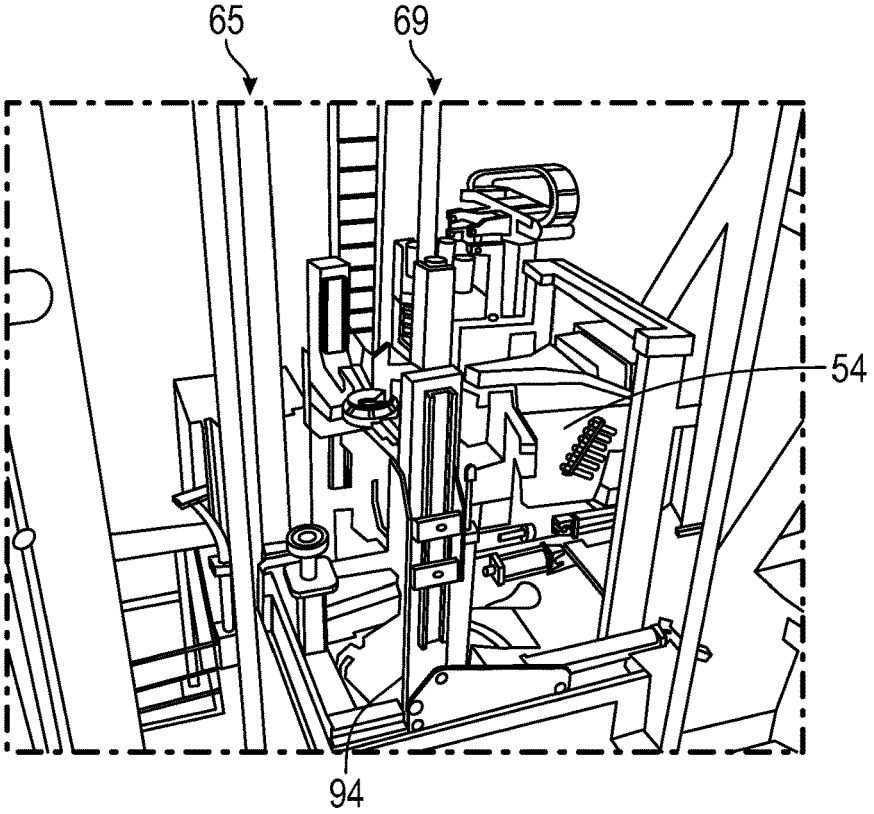
FIG. 22 illustrates an eighth view of the movable platform of FIG. 15 in the second tripping operation, in accordance with an embodiment.
Figure 23:
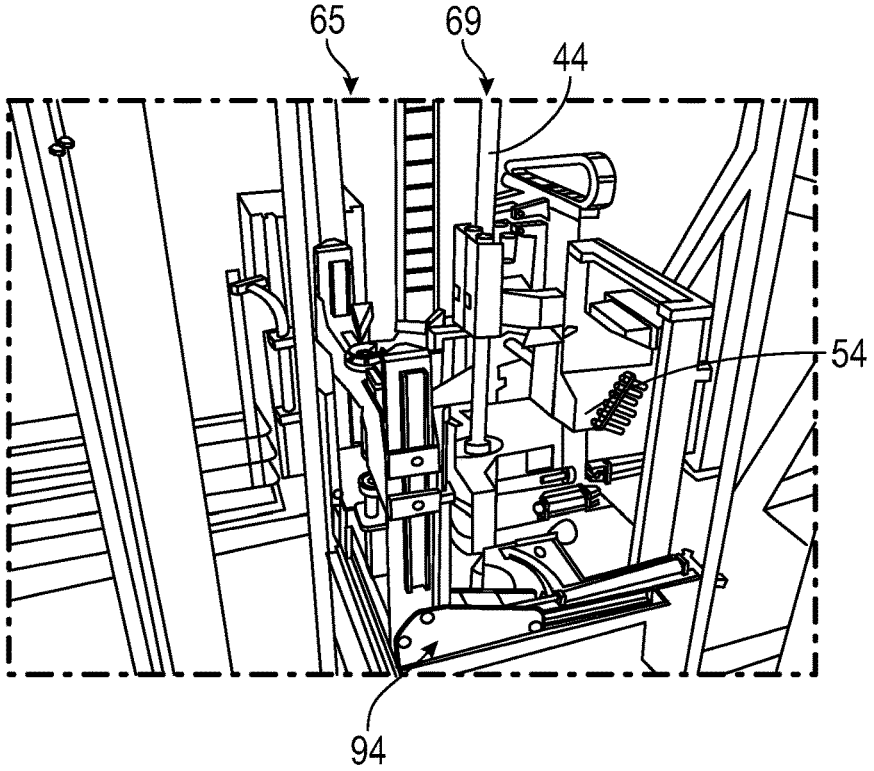
FIG. 23 illustrates a ninth view of the movable platform FIG. 15 in the second tripping operation, in accordance with an embodiment.

FIG. 22 illustrates a subsequent step in the tripping operation subsequent to that illustrated in FIG. 21, whereby the support member 94, no longer supporting the tubular segment 44, moves in a direction towards the first position 65 (i.e., the storage position) at the edge of an upper face 67 of the movable platform 28, from the second position 69 (e.g., the deployment position) at a central region of the upper face 67 at which the roughneck 54 is making up the tubular segment 44 and the tubular segment 46. FIG. 23 illustrates a subsequent step in the tripping operation subsequent to that illustrated in FIG. 22, whereby the support member 94 reaches the first position 65 (i.e., the storage position) at the edge of an upper face 67 of the movable platform 28, from the second position 69 (e.g., the deployment position) at a central region of the upper face 67 at which the roughneck 54 is making up the tubular segment 44 and the tubular segment 46.

Figure 24:
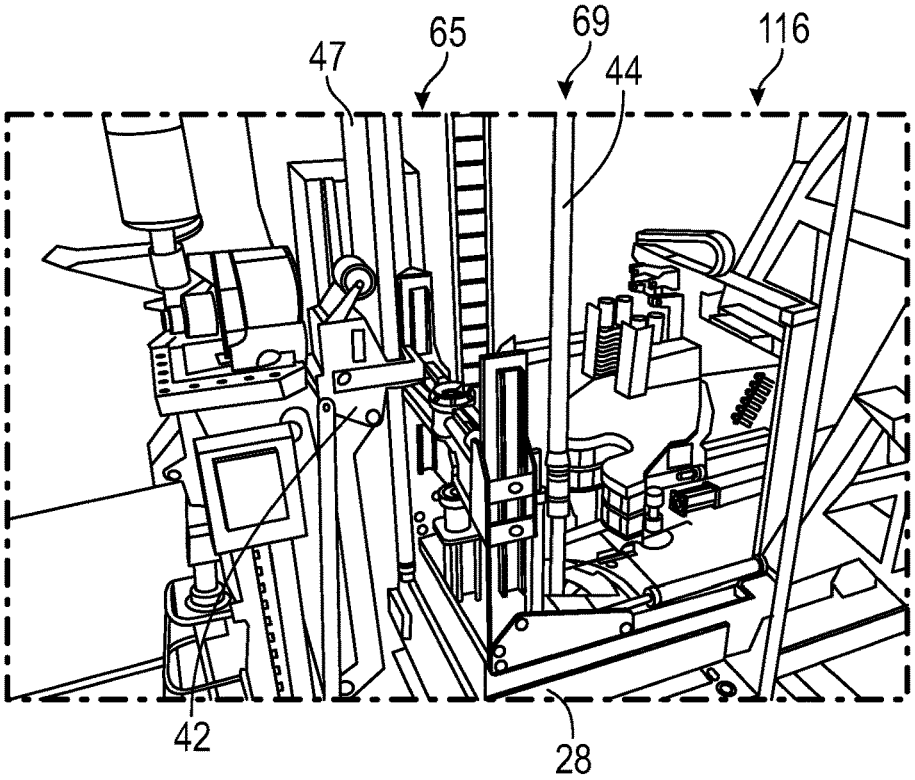
FIG. 24 illustrates a tenth view of the movable platform of FIG. 15 in the second tripping operation, in accordance with an embodiment.

While this is occurring, the bails 39, elevator 40, and top drive 38 may move into a position to latch to the upper portion of the tubular segment, as will be described in greater detail below. Once in this position, the elevator 40 will be available to close upon the tubular segment 44 so as to transfer the weight of the drill string from the rotary table 32 to the top drive 38 and elevator 40. This allows the roughneck 54 to move away from the second position 69 and return to a storage position 116, as illustrated in FIG. 24, which illustrates a subsequent step in the tripping operation subsequent to that illustrated in FIG. 23. The movable platform 28 may continue to move towards the drill floor 26 as the block and tackle system or other system for movement of the top drive 38, the elevator 40, and the tubular segment 44 towards the wellbore. As the movable platform approaches the drill floor 26, the tubular handling apparatus 42 is positioned with tubular segment 47.

Figure 25:
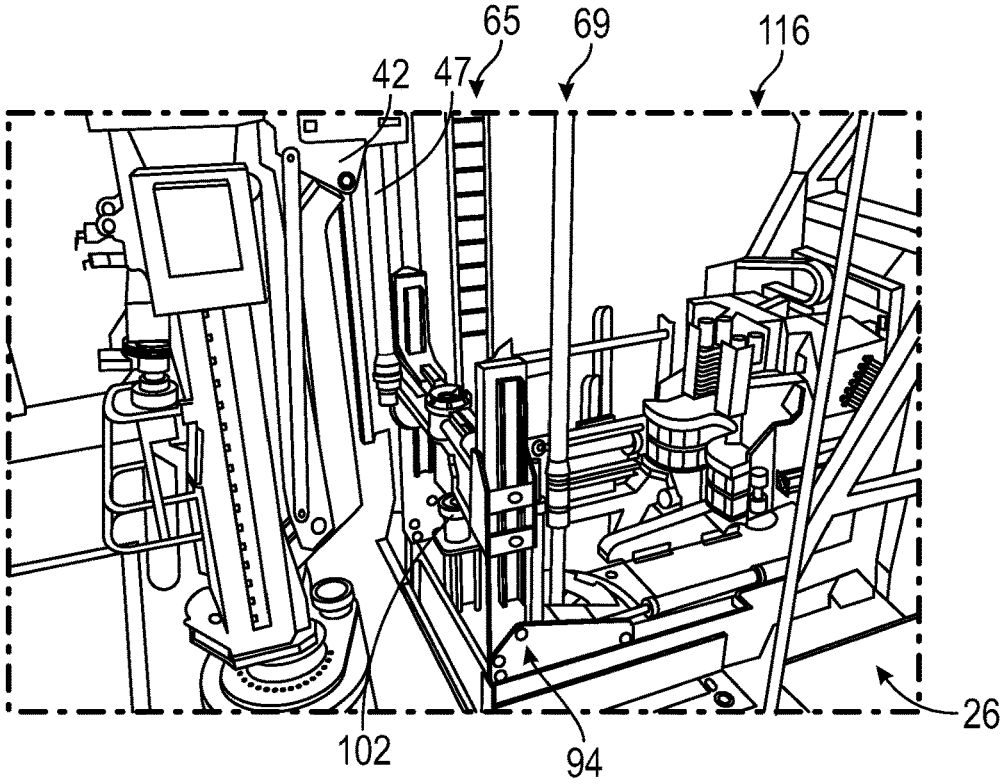
FIG. 25 illustrates an eleventh view of the movable platform of FIG. 15 in the second tripping operation, in accordance with an embodiment.

In FIG. 25, illustrative of a step in the tripping operation subsequent to that illustrated in FIG. 24, the tubular handling apparatus 42 raises the tubular segment 47 and will position the tubular segment 47 into receptacle 102 at which time, the above described process begins anew. Likewise, it should be appreciated that the steps described above may be reversed to allow for a tripping-out operation to occur.

Figure 26:
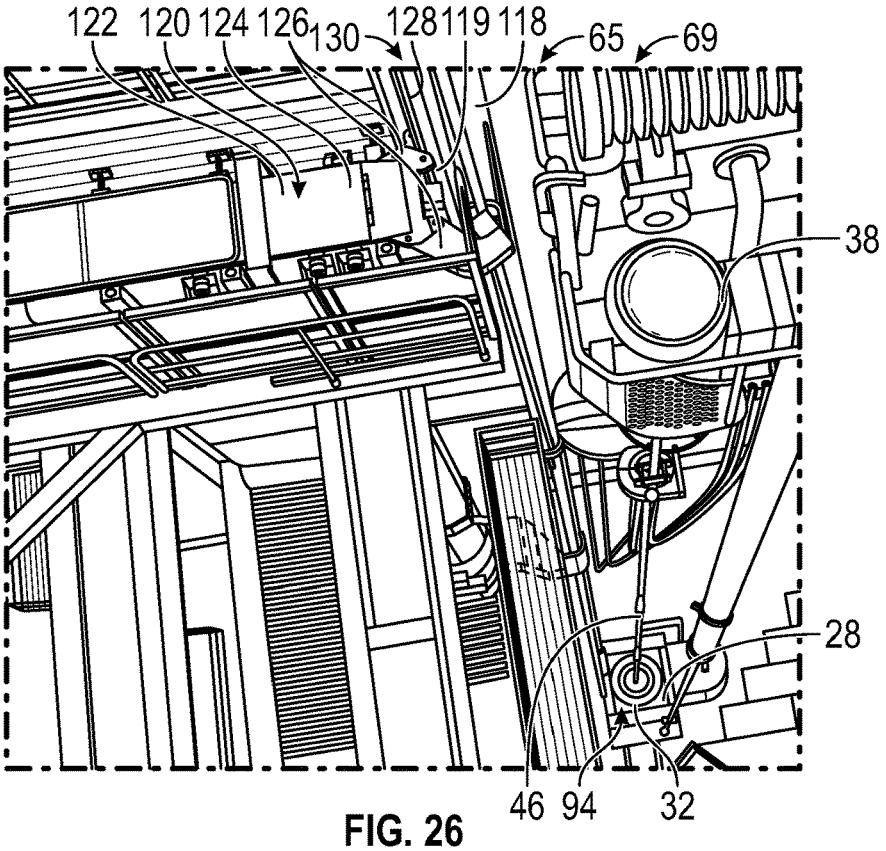
FIG. 26 illustrates a first view of a guide element for use with the movable platform of FIG. 15 in the second tripping operation, in accordance with an embodiment.

As noted above, in some embodiments, the guide member 90 may be substituted or replaced. For example, FIG. 26 illustrates a guide member 118 that may be used in place of guide member 90 and, for example, in conjunction with the support member 94. The guide member 118 may be supported via a guide support 120. The guide support 120 may include a support arm 122 from which a movable arm 124 extends and retracts or the support arm 122 itself may extend and retract. The movable arm 124 may additionally include clasping members 126 that operate to clasp and support the guide member 118.

The guide member 118 may be raised and lowered with a cable and sheave arrangement, direct acting cylinders, suspended winch mechanism, or similar internal or external actuation system. In some embodiments, the guide member 118 may use lateral supports 119 such as, for example, pads that may be made of Teflon-graphite material or another low-friction material (e.g., a composite material) that allows for motion of the guide member 118 relative to drill floor with reduced friction characteristics while still being coupled to the guide support 120. In addition to, or in place of the aforementioned pads, other lateral supports 119 including bearing or roller type supports (e.g., steel or other metallic or composite rollers and/or bearings) may be utilized. The lateral supports 119 may allow the guide member 118 to interface with a support element 128 (e.g., guide tracks) so that the guide member 118 is movably coupled to the guide support 120. Accordingly, the guide member 118 may be movably coupled to the guide support 120 to allow for movement of the guide member 118 (e.g., towards and away from the drill floor and/or the tubular segment support system while maintaining contact with the guide tracks or other connection element). In some embodiments, one or more of the lateral supports 119 may be disposed on the movable arm 124 and/or the clasping members 126.

As illustrated, the guide member 118 may be disposed at a position 130, which may be between a location where the tubular handling apparatus 42 is located with tubular segment 47 in FIG. 24 and first position 65. The guide member 118 may operate as a restriction element of the tubular segment 44 by restricting movement of the tubular segment 44 (i.e., lateral movement across the upper face 67 of the movable platform) distinct from any lateral movement imparted by support member 63 or movement imparted by the movable platform 28. That is, the guide member 118 may provide lateral support and/or restrict lateral movement of an upper portion of the tubular segment 44.

In some embodiments, the guide member 118 may cylindrically surround or partially surround the tubular segment 44 and, for example, may include apertures (in a top and bottom region of the guide member 118) that allow for the tubular segment to pass through the guide member 118. Accordingly, the guide member may be a sheath, cylinder, or include other elongated shaped. Due to the ability of the movable arm 124 to extend and retract, the guide member 118 may continue to provide lateral support and/or prevent lateral movement (e.g., prevent lateral movement of the tubular segment 44 when the tubular segment is held by the tubular handling apparatus 42 at position 130, while the tubular segment 44 moves to position 69, and while the tubular segment 44 moves to position 65.

Figure 27:
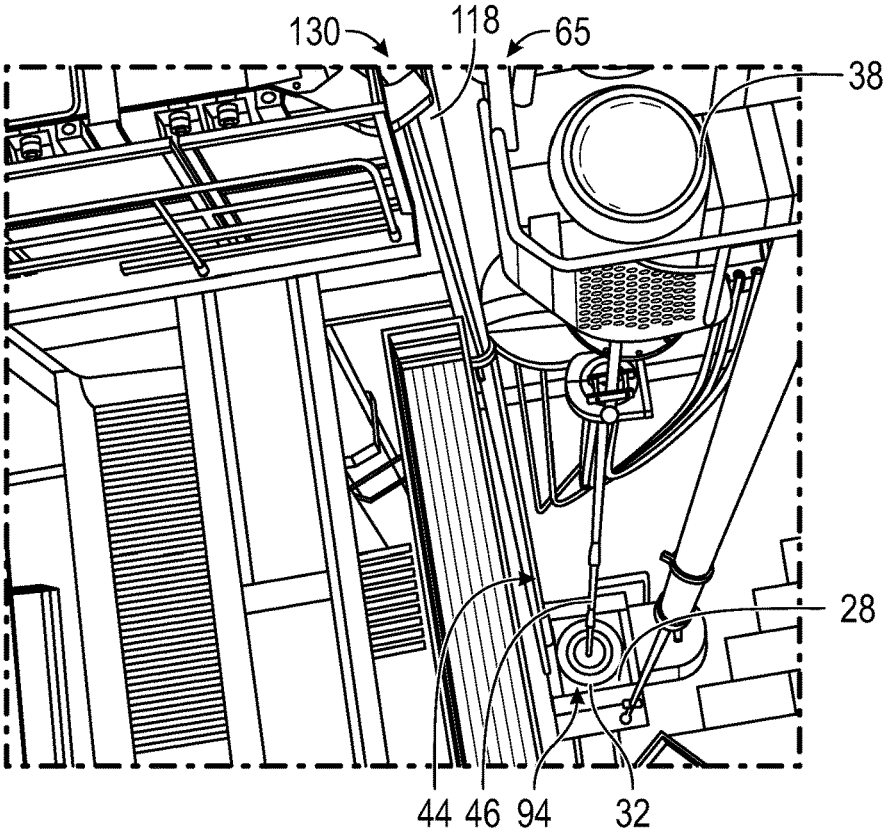
FIG. 27 illustrates a second view of the guide element for use with the movable platform of FIG. 15 in the second tripping operation, in accordance with an embodiment.
Figure 28:
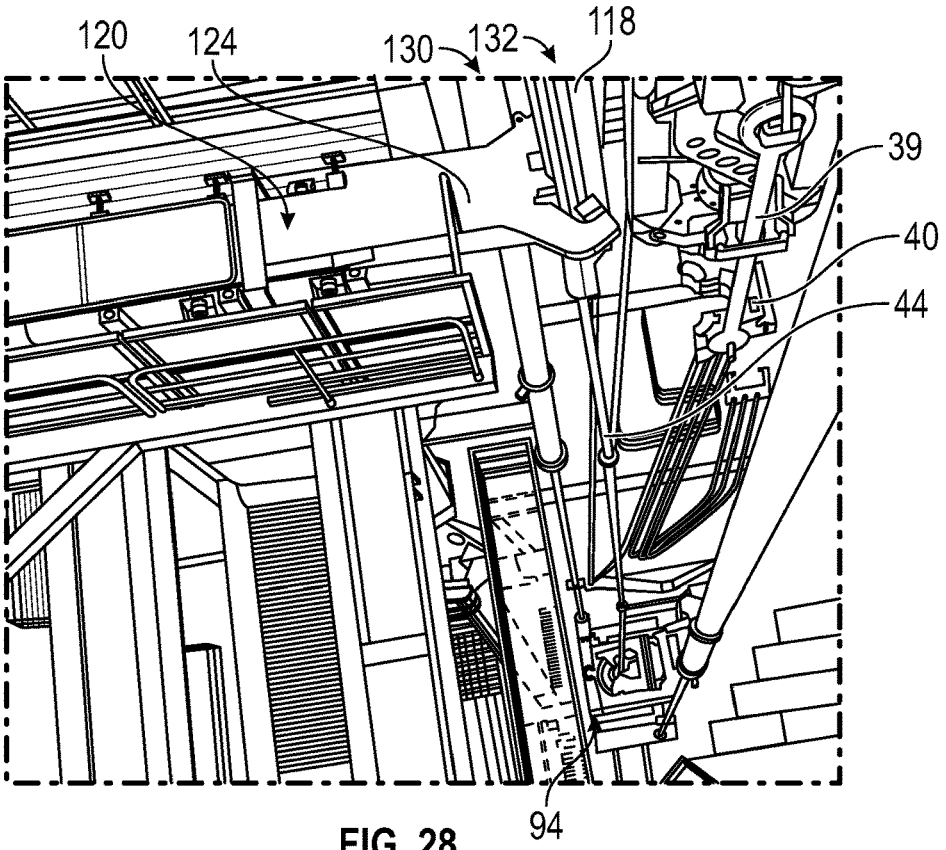
FIG. 28 illustrates a third view of the guide element for use with the movable platform of FIG. 15 in the second tripping operation, in accordance with an embodiment.

FIG. 27 illustrates a step in the tripping operation illustrated during a period of time between FIGS. 17 and 18 as well as subsequent to the step illustrated in FIG. 26. In FIG. 27, the guide member 118 is located at first position 65 and is moving away from the drill floor 26 in conjunction with the movable platform 28. FIG. 28 illustrates a step in the tripping operation illustrated during a period of time described above with respect to FIG. 23 as well as subsequent to the step illustrated in FIG. 27. As illustrated in FIG. 28, the bails 39, elevator 40, and top drive 38 are moving into a position to latch to the upper portion of the tubular segment 44. The guide support 120 may have its movable arm 124 extended so that the guide member is disposed at position 132, while laterally supporting the tubular segment 44 at second position 69. The guide member 118 may be disposed in its uppermost position away from drill floor 26.

Figure 29:
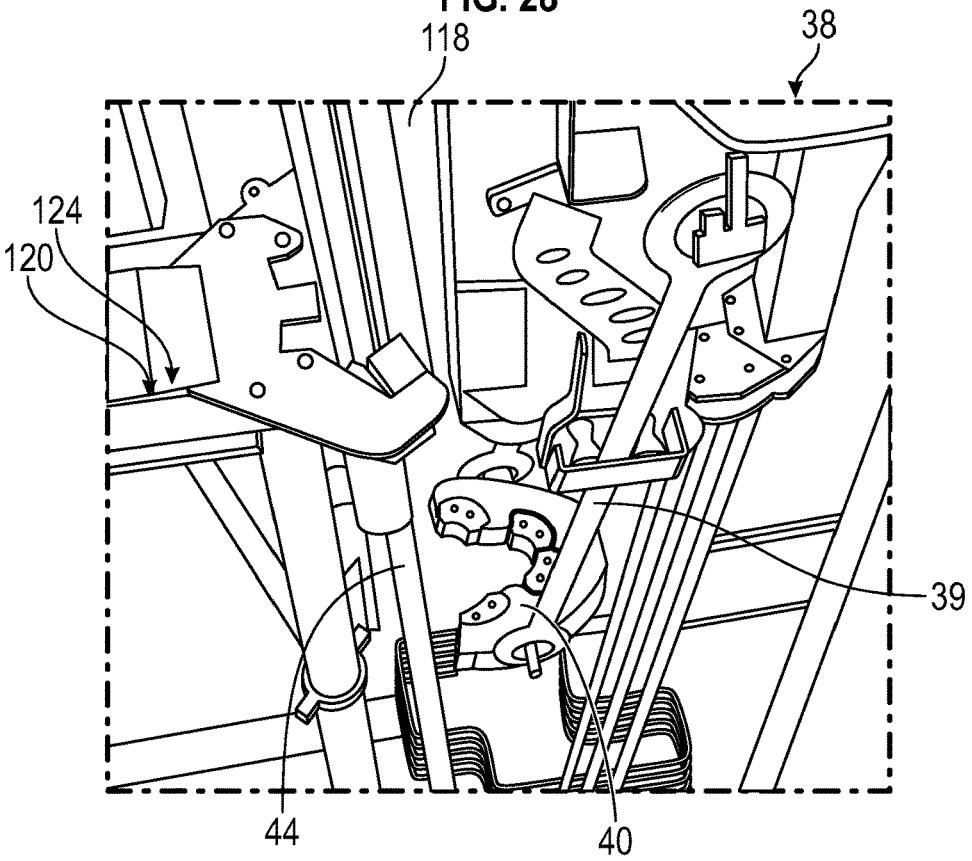
FIG. 29 illustrates a fourth view of the guide element for use with the movable platform of FIG. 15 in the second tripping operation, in accordance with an embodiment.
Figure 30:
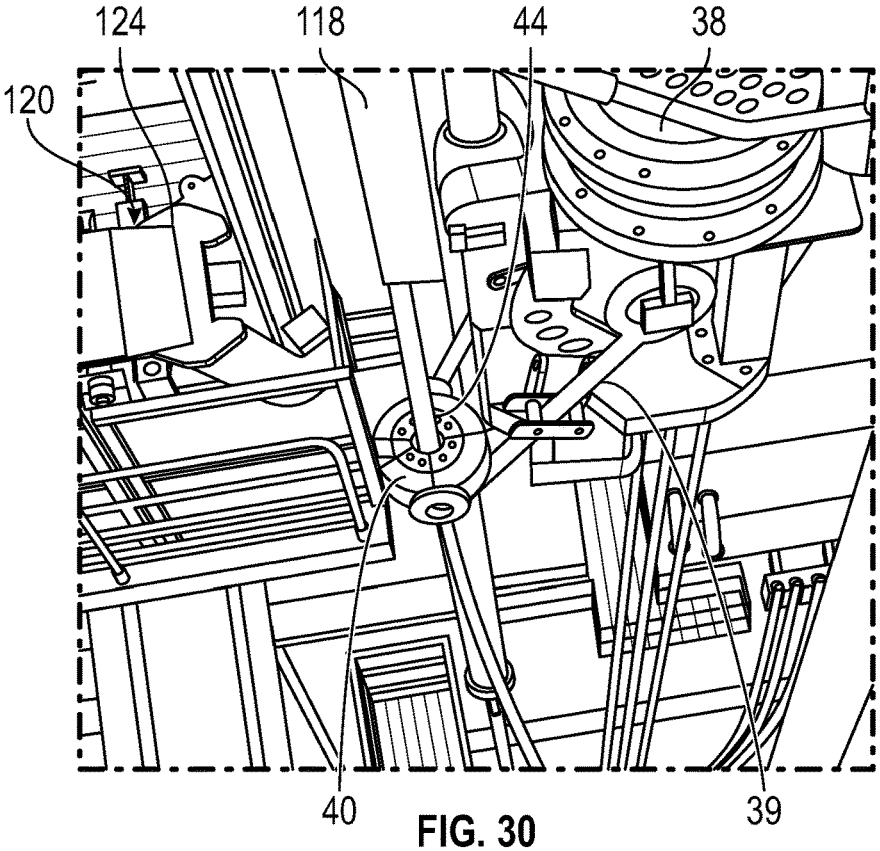
FIG. 30 illustrates a fifth view of the guide element for use with the movable platform of FIG. 15 in the second tripping operation, in accordance with an embodiment.

FIG. 29 illustrates a continuation of a step in the tripping operation illustrated during a period of time described above with respect to FIG. 23 and subsequent to step illustrated in FIG. 28. In FIG. 29, the top drive 38, the bails 39, and the elevator 40 extend towards the guide member 118. As this occurs, the movable arm 124 may retract the guide member 118, which may allow the tubular segment 44, for example, to be advantageously (e.g., to more easily expose the tubular segment 44 to the elevator 40 for connection). FIG. 30 illustrates a continuation of a step in the tripping operation illustrated during a period of time described above with respect to FIG. 23 and subsequent to step illustrated in FIG. 29. In FIG. 30, the top drive 38, the bails 39, and the elevator 40 continue to extend towards the guide member 118. As this occurs, the movable arm 124 continues to retract the guide member 118. As illustrated, the elevator 40 is beginning to close about the tubular segment 44. The guide member 118 may still be disposed in its uppermost position away from drill floor 26 and the tubular segment 44 continues to move through the guide member 118 as the movable platform is moving towards the drill floor 26.

Figure 31:
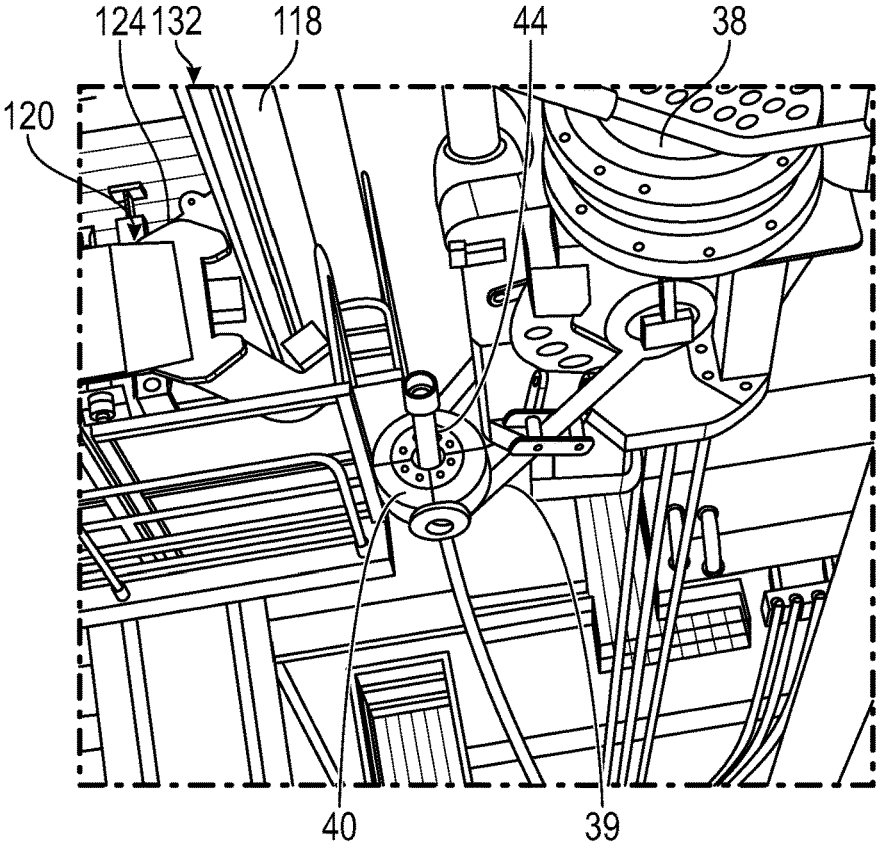
FIG. 31 illustrates a sixth view of the guide element for use with the movable platform of FIG. 15 in the second tripping operation, in accordance with an embodiment.
Figure 32:
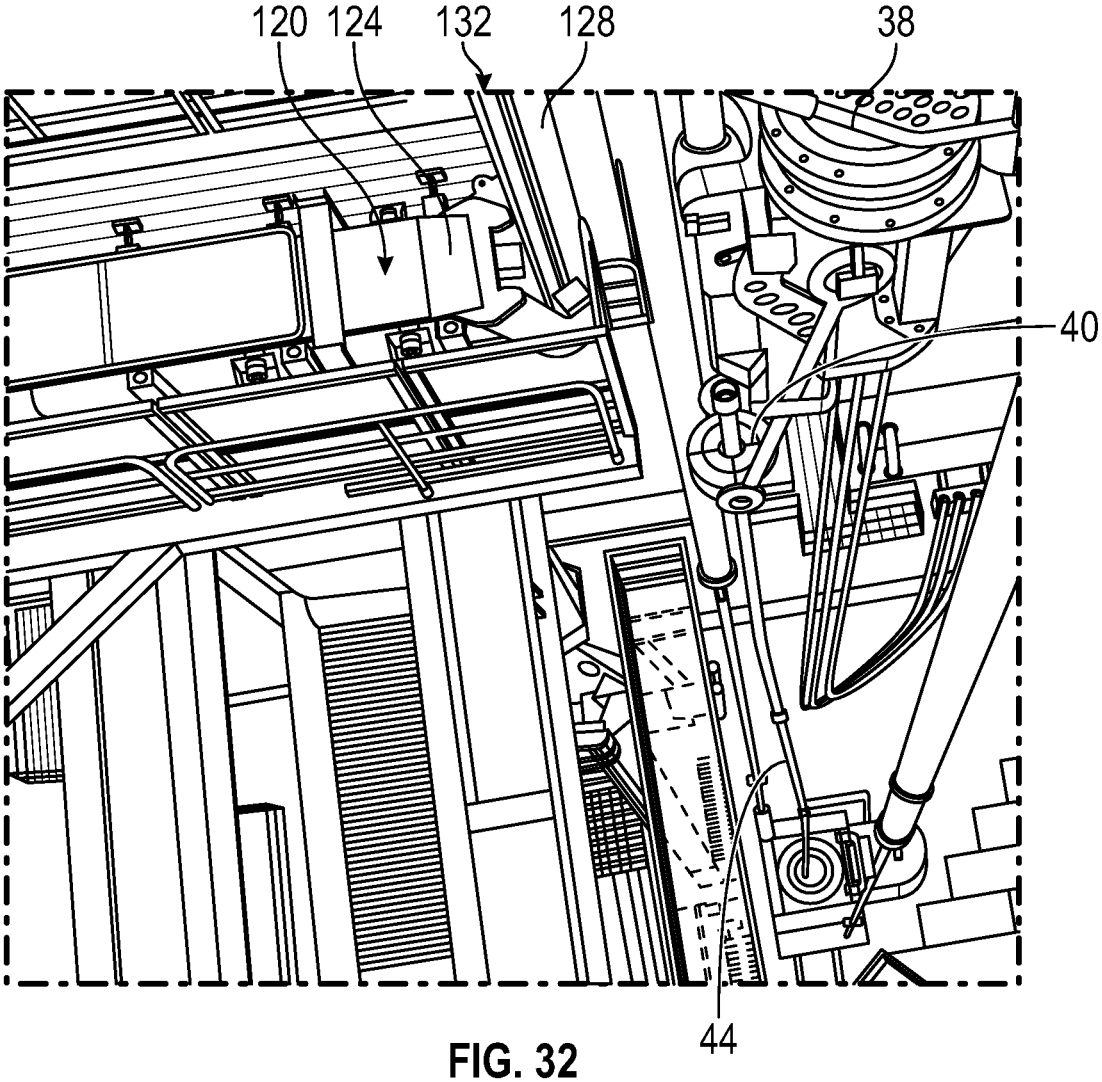
FIG. 32 illustrates a seventh view of the guide element for use with the movable platform of FIG. 15 in the second tripping operation, in accordance with an embodiment.

FIG. 31 illustrates a continuation of a step in the tripping operation illustrated during a period of time described above with respect to FIG. 23 and subsequent to step illustrated in FIG. 30. In FIG. 31, the elevator 40 has closed about the tubular segment 44, which has exited the guide member 118. The guide member 118 is disposed in position 132, in line with the location of the tubular handling apparatus 42 holding the tubular segment 47. The guide member 118 begins to move towards the drill floor 26 so as to support the tubular segment 47 and the closing of the elevator 40 about the tubular segment 44 allow for the transfer of the weight of the drill string from the rotary table 32 to the top drive 38 and elevator 40. This allows the roughneck 54 to move away from the second position 69 and return to a storage position 116, as illustrated in FIG. 24, which corresponds to FIG. 32 subsequent to the step illustrated in FIG. 31.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A system, comprising:

a movable platform slidingly coupled to one or more supports and configured to be selectively moved vertically or at an incline towards a drill floor and away from the drill floor;

a roughneck disposed on the movable platform and configured to make up or break out a threaded joint between a first tubular segment and a second tubular segment; and a support member disposed on the movable platform and configured to support one of the first tubular segment or the second tubular segment as the movable platform is selectively moved vertically or at an incline towards the drill floor or away from the drill floor, wherein the support member comprises a receptacle having a base configured to provide support to the first tubular segment in a first direction away from the drill floor when a first bottommost portion of the first tubular segment is disposed into the receptacle or to provide support to the second tubular segment in the first direction away from the drill floor when a second bottommost portion of the second tubular segment is disposed into the receptacle.

2. The system of claim 1, wherein the support member is configured to move the first tubular segment or the second tubular segment across the movable platform as the movable platform is selectively moved vertically or at an incline towards the drill floor or away from the drill floor.

3. The system of claim 1, wherein the support member is configured to move the second tubular segment from a storage position at an edge of an upper face of the movable platform to a deployment position at a central region of the upper face of the movable platform as the movable platform moves vertically or at an incline towards the drill floor to provide the second tubular segment for the make up of the threaded joint between the first tubular segment and the second tubular segment.

4. The system of claim 1, wherein the support member is configured to move the second tubular segment from a deployment position at an central region of an upper face of the movable platform to a storage position at an edge of the upper face of the movable platform as the movable platform moves vertically or at an incline away from the drill floor to withdraw the second tubular segment from the break out of the threaded joint between the first tubular segment and the second tubular segment.

5. The system of claim 1, wherein the base of the receptacle directly contacts the first bottommost portion of the first tubular segment when the first tubular segment is disposed into the receptacle and directly contacts the second bottommost portion of the second tubular segment when the second tubular segment is disposed into the receptacle.

6. The system of claim 5, wherein the receptacle comprises one or more support walls that provide support to the first tubular segment or the second tubular segment in a second direction perpendicular to the first direction.

7. The system of claim 6, wherein the one or more support walls circumferentially surround or partially circumferentially surround the base of the receptacle.

8. The system of claim 5, wherein the support member comprises a movable support configured to move towards and away from the movable platform.

9. The system of claim 8, wherein the movable support comprises a constriction element configured to grasp the first tubular segment or the second tubular segment when disposed in the movable support.

10. The system of claim 9, wherein the support member is configured be coupled to a guide or track, wherein the support member is configured to move along the guide or track between a storage position at an edge of an upper face of the movable platform and a deployment position at a central region of the upper face of the movable platform.

11. The system of claim 5, wherein the support member comprises an arm comprising the receptacle, wherein the arm is configured to rotate between a storage position at an edge of an upper face of the movable platform and a deployment position at a central region of the upper face of the movable platform.

12. A method, comprising:

grasping a first tubular segment via slips of a movable platform;

moving vertically or at an incline the movable platform along one or more supports towards a drill floor;

supporting a second tubular segment via a support member of the movable platform as the movable platform moves vertically or at an incline towards the drill floor, wherein supporting the second tubular segment comprises disposing a bottommost portion of the second tubular segment into a receptacle to directly contact a base of the receptacle to support to the second tubular segment in a first direction away from the drill floor;

utilizing the support member to align the second tubular segment with the first tubular segment while the movable platform is moving vertically or at an incline towards the drill floor; and making-up the first tubular segment and the second tubular segment to directly couple the first tubular segment and the second tubular segment while the movable platform is moving vertically or at an incline towards the drill floor.

13. The method of claim 12, wherein utilizing the support member comprises moving the support member across the movable platform as the as the movable platform is moved vertically or at an incline towards the drill floor or away from the drill floor.

14. The method of claim 13, wherein moving the support member comprises rotating an arm of the support member across an upper face of the movable platform from a storage position at an edge of the upper face of the movable platform to a deployment position at a central region of the upper face of the movable platform.

15. The method of claim 12, wherein utilizing the support member comprises grasping the second tubular segment and removing the second tubular segment from a receptacle of the support member in a direction away from the drill floor.

16. The method of claim 15, wherein utilizing the support member comprises moving the support member along an upper face of the movable platform from a storage position at an edge of the upper face of the movable platform to a deployment position at a central region of the upper face of the movable platform.

17. An apparatus, comprising:

a movable platform comprising a first portion sized to store a tripping apparatus thereon and a second portion housing slips;

a support member configured to support a tubular segment utilized by the tripping apparatus in a tripping operation as the movable platform is selectively moved vertically or at an incline towards a drill floor or away from the drill floor, wherein the movable platform comprises a third portion sized to store the support member, wherein the support member comprises a receptacle having a base configured to provide support to the tubular segment in a first direction away from the drill floor when a first bottommost portion of the tubular segment is disposed into the receptacle; and a guide member disposed linearly above the support member in the first direction and configured to restrict lateral movement of the tubular segment when the tubular segment is supported by the support member.

18. The apparatus of claim 17, wherein the support member is configured to move the tubular segment across the movable platform as the movable platform is selectively moved vertically or at an incline towards the drill floor or away from the drill floor.

19. The apparatus of claim 18, wherein the guide member is configured to move in conjunction with the tubular segment across the movable platform.

20. The apparatus of claim 17, comprising an actuating system coupled to the guide member and configured to selectively move the guide member vertically or at an incline towards the drill floor and away from the drill floor.

* * * * *